US011598066B2

(12) United States Patent
Lim

(10) Patent No.: US 11,598,066 B2
(45) Date of Patent: Mar. 7, 2023

(54) BUILDING SYSTEM

(71) Applicant: NXT IP PTY LTD, Canning Vale (AU)

(72) Inventor: Matakii Lim, Canning Vale (AU)

(73) Assignee: NXT Building System Pty. Ltd., Canning Vale (AU)

( * ) Notice: Subject to any disclaimer, the term of this patent is extended or adjusted under 35 U.S.C. 154(b) by 114 days.

(21) Appl. No.: 16/954,442

(22) PCT Filed: Dec. 14, 2018

(86) PCT No.: PCT/AU2018/051343

§ 371 (c)(1),
(2) Date: Jun. 16, 2020

(87) PCT Pub. No.: WO2019/113651

PCT Pub. Date: Jun. 20, 2019

(65) Prior Publication Data

US 2021/0087773 A1 Mar. 25, 2021

(30) Foreign Application Priority Data

Dec. 16, 2017 (AU) ..... 2017905037
Dec. 17, 2017 (AU) ..... 2017905038

(51) Int. Cl.
*E02D 27/01* (2006.01)
*E02D 5/22* (2006.01)
(Continued)

(52) U.S. Cl.
CPC ..... *E02D 27/016* (2013.01); *E02D 5/223* (2013.01); *E02D 5/56* (2013.01); *E04B 5/32* (2013.01);
(Continued)

(58) Field of Classification Search
CPC ..... E02D 27/016; E02D 5/223; E02D 5/56; E02D 2200/1671; E04B 5/32
See application file for complete search history.

(56) References Cited

U.S. PATENT DOCUMENTS 3,224,151 A 12/1965 Nystrom
5,884,442 A * 3/1999 Breault ..... E04C 5/065 52/223.6
(Continued)

FOREIGN PATENT DOCUMENTS

AU 1636188 B 11/1988
AU 2010224302 A1 9/2010
(Continued)

*Primary Examiner* — Gisele D Ford
(74) *Attorney, Agent, or Firm* — Blanchard Horton PLLC

(57) ABSTRACT

The present invention relates to a building system and a method of making and assembling the building system. In particular, the present invention relates to a footing for a building structure, the footing comprises a plurality of precast concrete layers, each precast concrete layer comprising reinforcement bars and a plurality of apertures. The footing further comprises a base structure comprising a base plate and a plurality of alignment bars protruding from the base plate. The footing is configured such that when the plurality of precast concrete layers are positioned on top of one another, the plurality of alignment bars of the base structure extend through the respective apertures of each precast concrete layer. Furthermore, the present invention relates to a building structure having one or more building modules.

17 Claims, 21 Drawing Sheets

(51) Int. Cl.
*E02D 5/56* (2006.01)
*E04B 5/32* (2006.01)
*E04B 1/24* (2006.01)

(52) U.S. Cl.
CPC .... *E02D 2200/1671* (2013.01); *E04B 1/2403* (2013.01); *E04B 2001/2415* (2013.01); *E04B 2001/2421* (2013.01); *E04B 2001/2451* (2013.01); *E04B 2001/2457* (2013.01)

(56) References Cited

U.S. PATENT DOCUMENTS

2004/0025463 A1* 2/2004 Yauchi ..... E04B 2/8635 52/426
2005/0072061 A1* 4/2005 Marty ..... E04B 1/165 52/79.1
2010/0054864 A1* 3/2010 Stroyer ..... E02D 5/52 405/244
2011/0219713 A1* 9/2011 Zarraonandia ..... E02D 27/01 52/745.21
2012/0328374 A1* 12/2012 El Naggar ..... E02D 5/56 405/233
2015/0176278 A1* 6/2015 Reigstad ..... E04B 5/32 52/223.6
2015/0345096 A1* 12/2015 Ong ..... E02D 5/226 405/252
2017/0159256 A1* 6/2017 Li ..... E02D 5/24

FOREIGN PATENT DOCUMENTS

AU 2010226975 A1 4/2011
CN 101255700 A 9/2008
CN 104164839 A 11/2014
CN 204940318 U 1/2016
CN 106894437 A 6/2017
GB 2192916 A 1/1988
JP 2017002591 A 1/2017
KR 1020120003814 B1 7/2012
NL 8004538 A 3/1982

* cited by examiner

BUILDING SYSTEM

CROSS-REFERENCE TO RELATED APPLICATIONS

This application is a U.S. national phase under 35 U.S.C. § 371 of International Patent Application No. PCT/AU18/51343 filed Dec. 14, 2018, which in turn claims the priority of Australian Patent Application No. AU 2017905037 filed Dec. 16, 2017 and the priority of Australian Patent Application No. AU 2017905038 filed Dec. 17, 2017. The disclosures of such international patent application and Australian priority patent applications are hereby incorporated herein by reference in their respective entireties, for all purposes.

TECHNICAL FIELD

The present invention relates to a building system and a method of making and assembling the building system. In particular, the present invention relates to a footing for a building structure, and a method of making the footing and assembling the footing on a building site where the building structure is erected. Furthermore, the present invention relates to a building structure having one or more building modules and a method of assembling the building structure.

BACKGROUND

The process of erecting a building structure is typically a costly and cumbersome exercise.

Some building structures include prefabricated components that are manufactured off-site and, prior to the process of erecting the building structure, the prefabricated components are taken to a building site. The components are typically made in a factory and transported to the building site. At the building site, the prefabricated components are assembled together to erect the building structure. However, with conventional prefabricated building structures, there may still be a lot of on-site manufacturing and wet work involved to erect the building structure and make the building structure structurally sound.

The process of assembling the components of a conventional prefabricated building structure on-site typically are a cumbersome process and requires skilled labour as well as specialised machinery. This increases the cost for erecting the building structure.

It would be advantageous if embodiments of the present invention would simplify the process of transporting and assembling the building structure or at least provide an alternative to conventional prefabricated building structures.

One exemplary component of a building structure which may or may not be prefabricated relates to a footing that is part of a foundation connecting the building structure to the ground. Some foundations include multiple footings and respective piles that are arranged to transfer the load of the building structure to the ground.

Conventional footings are typically not prefabricated and made of concrete with reinforcement bars that are poured into an excavated trench on-site. The main function of footings is to support the foundation and prevent settling. Footings are particularly important in areas with troublesome soils, for example due to movement of the soil as a result of moisture changes.

It would be advantageous if embodiments of the present invention would simplify the process of making a footing of a building structure or at least provide an alternative to conventional footings, for example for building structures that include prefabricated building components.

Any discussion of documents, acts, materials, devices, articles or the like which have been included in the present specification is not to be taken as an admission that any or all of these matters form part of the prior art base or were common general knowledge in the field relevant to the present invention as it existed before the priority date of each claim of this application.

Throughout the specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

Embodiments of the present invention relate to a footing for a building structure, the footing comprising:

a plurality of precast concrete layers, each precast concrete layer comprising reinforcement bars and a plurality of apertures, and a base structure comprising a base plate and a plurality of alignment bars protruding from the base plate, wherein the footing is configured such that when the plurality of precast concrete layers are positioned on top of one another, the plurality of alignment bars of the base structure extend through the respective apertures of each precast concrete layer.

The base structure may further be configured to secure the footing to a piling structure. In particular, the base plate of the base structure may be directly secured to the piling structure. For example, the base plate may be secured to the piling structure by virtue of a fastener. In this regard, it will be appreciated that any suitable method of securing the base plate to the piling structure is envisaged, such as welding or using mechanical fasteners, such as bolts.

In one example, the base structure may further comprise a centre column and the footing may be configured such that when the plurality of precast concrete layers are positioned on top of one another, the centre column extends through all of the plurality of precast concrete layers. In this regard, each precast concrete layer may comprise a central aperture for receiving the centre column. This arrangement typically provides more stability, in particular if a vertical column of a building structure is positioned directly above and connected to the centre column of the footing. The centre column may be directly secured to the piling structure. Any suitable method for securing the centre column to the piling structure is envisaged, including welding and the use of mechanical fasteners, such as bolts.

Each precast concrete layer may comprise a plurality of steel tubes defining the plurality of apertures for receiving the respective alignment bars when the concrete layer is cast. In this regard, the steel tubes are typically attached to the reinforcement bars prior to the casting process. The steel tubes may provide for a snug fit for receiving the alignment bars such that the plurality of precast concrete layers are substantially aligned when positioned on top of one another. Gaps between the alignment bars and the plurality of precast concrete layers may subsequently be filled with grout or any other suitable setting material.

The base plate may comprise connectors arranged to position the alignment bars relative to the base plate such that the alignment bars protrude from the base plate, for example at a substantially right angle. The alignment bars typically protrude upwards when the building structure is erected. As such, the connectors are typically arranged at a top face of the base plate. For example, the alignment bars may protrude substantially perpendicular from the top face of the base plate. In one example, the alignment bars are attached to the connectors by virtue of fasteners, for example by virtue of bolts or welding. In one example, the connectors may be welded to the base plate and the alignment bars may be connected to the connectors via bolts or thread. This arrangement has the advantage that most of the components of the footing can be transported in a relatively compact manner and the footing can be assembled on the building site. In some embodiments, most or all components of the footing can be assembled at the building site without the need for welding. Using a plate as part of the base structure of the footing further has the advantage that the base plate may also function as a levelling point for the footing. In other words, when the footing is positioned at the building site to be assembled, the footing can be levelled by levelling the base plate.

The base plate may further comprise a support structure that is arranged at a bottom face of the base plate. In this regard, the bottom face of the base plate is opposite to the top plate and typically faces downward when the footing of the building structure is assembled, and the building structure is erected. The support structure may be configured to provide further stability to the footing. Furthermore, the support structure may be configured such that horizontal movement of the footing, such as sliding or rotating, can be reduced or even prevented when the footing is positioned at the building site to be assembled. For example, the support structure may comprise a plurality of support elements, such as flanges, in the form of a web extending radially from a centre of the base plate. However, other configurations and shapes of the support structure are envisaged.

One or more of the precast concrete layers may comprise connectors configured to receive slab reinforcement bars that, in use, extend into a concrete slab formed between a plurality of footings. The connectors may be attached to the reinforcement bars of each concrete layer prior to the casting process. The concrete slab and the plurality of footings together with respective piling structures typically form the foundation of a building structure. In one example, the one or more precast concrete layers may comprise the slab reinforcement bars with or without the above-mentioned connectors. The connectors and/or the slab reinforcement bars may be embedded within the concrete layers when the concrete layers are cast. If the concrete slab between the plurality of footings is precast, the concrete slab may comprise a plurality of recesses for receiving the respective slab reinforcement bars. Gaps between the concrete slab and the slab reinforcement bars may then be filled with grout or any other suitable setting material.

The footing may further comprise a column plate that is arranged to secure the footing to a vertical column of a building structure such that the footing directly supports the vertical column of the building structure. In one example, one or more of the precast concrete layers may comprise apertures for receiving column reinforcement bars to secure the column plate to the one or more precast concrete layers. The vertical column of the building structure may then be connected to the column plate of the footing using mechanical fasteners, such as bolts. However, other methods of connecting the vertical column to the footing are envisaged. For example, the vertical column may comprise one or more grout tubes and bars may extend from the footing into the grout tubes of the vertical column. A space between the bars and the grout tubes may then be filled with grout to connect the vertical column to the footing.

In one particular embodiment, the footing may be arranged such that the footing, the vertical column and the piling structure are substantially aligned, when the building structure is erected.

The reinforcement bars of each concrete layer may comprise any suitable reinforcement material, such as steel, glass fibre and fibre reinforced plastic. The selection of the material for the reinforcement bars may depend on building requirements on the building site, transport weight and material costs. In some specific examples, each concrete layer comprises a reinforcement steel mesh. Any structural features of the concrete layers such as steel tubes, connectors, spacer chairs or lifting elements may be connected to the reinforcement steel mesh so that the structural features can be embedded within the layer during the casting process. Each concrete layer may comprise one or more lifting elements such that the precast concrete layers can be lifted by a lifting or handling machine. Each concrete layer may comprise one or more spacer chairs such that the reinforcement bars of the layer can be elevated from a surface during the casting process. In this way, it can be ensured that the reinforcement bars are not visible once the concrete layer has been cast.

In one embodiment, the footing may further comprise a piling structure. The piling structure may comprise one or more screw or helical piles. The piling structure may have an overall substantial conical shape.

Embodiments of the present invention relate to a building structure comprising a plurality of vertical columns and a plurality of footings as described above. The building structure may further comprise a concrete slab extending between the plurality of footings.

Embodiments of the present invention relate to a method of making a footing for a building structure, the method comprising:

providing a base structure comprising a base plate and a plurality of alignment bars protruding from the base plate; and providing a plurality of precast concrete layers, wherein each precast concrete layer is made by:

a) providing reinforcement bars for reinforcing the concrete layer;

b) connecting a plurality of spacer chairs to the reinforcement bars such that the reinforcement bars are elevated when positioned on a surface;

c) connecting a plurality of steel tubes to the reinforcement bars such that when the concrete layer is cast, the steel tubes define a plurality of apertures that are arranged to receive the respective alignment bars of the base structure when the footing is assembled; and d) pouring concrete into a casting mould to form the concrete layer.

Embodiments of the present invention relate to a method of assembling a footing for a building structure, the method comprising:

positioning a base structure at a building site, the base structure comprising a base plate and a plurality of alignment bars protruding from the base plate;

providing a plurality of precast concrete layers, each concrete layer comprising reinforcement bars and a plurality of apertures, and positioning the plurality of precast concrete layers on top of one another such that the plurality of alignment bars of the base structure extend through respective apertures of each precast concrete layer.

Embodiments of the present invention relate to a method of forming a foundation of a building structure, the method comprising:

providing a footing comprising a plurality of precast concrete layers, each precast concrete layer comprising reinforcement bars and a plurality of apertures; the footing further comprising a base structure comprising a base plate and a plurality of alignment bars protruding from the base plate;

securing a piling structure to the base plate of the footing;

positioning the piling structure and the base plate at a building site where the building structure is to be erected;

positioning the plurality of precast concrete layers on top of one another such that the plurality of alignment bars of the base structure extend through respective apertures of each precast concrete layer, and securing a vertical column of the building structure to the footing.

The method may comprise providing a concrete slab between a plurality of footings, wherein one or more of the precast concrete layers of each footing comprises connectors arranged to receive slab reinforcement bars to extend into the concrete slab provided between the plurality of footings. The method may further comprise a step of filing gaps between the slab reinforcement bars and the concrete slab with grout or any other suitable setting material.

Embodiments of the present invention relate to a building module for a prefabricated building structure, the building module comprising:

a plurality of prefabricated wall panels, each prefabricated wall panel comprising at least one longitudinally extending cavity;

a support frame having separable parts comprising a plurality of steel posts, a plurality of steel beams and a plurality of connecting brackets; and a plurality of tie rods, each tie rod configured to connect at least two steel beams and extending through a longitudinally extending cavity of a wall panel that forms a boundary wall;

wherein the plurality of prefabricated wall panels, the separable parts of the support frame and the plurality of tie rods are configured to be stackable such that a volume of the prefabricated building structure can be minimised for transporting the building module to a building site.

Thus, prefabricated components of the building module, including the prefabricated wall panels, the tie rods and the support frame, are broken down into their smallest portable package for transporting the building module. Embodiments of the present invention have significant advantages. In particular, by minimising the volume of the building module for transport, the transport of the building module can be simplified which may as a result be more cost effective. Furthermore, by providing the support frame in separable parts, no skilled labour or specialised machinery may be necessary at the building site as the support frame may be assembled in a simplified manner.

Furthermore, by providing tie rods as outlined above, a strength of the boundary walls may be significantly improved. In particular, physical impacts to the wall caused by external factors, such as storms or floods or the like, may be absorbed by the tie rods. This may reduce the overall damage to the building module.

In one example, the plurality of prefabricated wall panels, the separable parts of the support frame and the plurality of tie rods may be configured to be transported in at least one "flat pack". A flat pack as used herein means a transportation pack that is flat relative to a size of the building module when the building module has been assembled.

In one example, the building module may be configured so that the plurality of prefabricated wall panels, the separable parts of the support frame and the plurality of tie rods meet flat pack pallet standards of the North Atlantic Trade Organisation (NATO). In this way, the building module may be transportable on one or more pallets.

In one example, a size of at least one flatpack may be defined by a footprint of at least one of the prefabricated wall panels. Alternatively, the size may be defined by a footprint of a prefabricated panel forming a flooring panel or a ceiling panel.

In one example, the support frame may be assembled by connecting the plurality of separable parts using mechanical fasteners, such as bolts or threads. A person skilled in the art will appreciate that any mechanical fasteners are envisaged that are suitable such that a support frame for a prefabricated building can be formed. In one specific example, the fasteners comprise bolts.

In one embodiment, the steel beams may be channel beams, wherein each channel beam comprises a substantially rectangular web defining a longitudinal axis of the channel beam and a pair of flanges protruding from the web such that a C-shaped channel is formed along the longitudinal axis. The channel beam may also be referred to as a purlin in the technical field of the invention.

The plurality of prefabricated wall panels may be configured to fit at least partially into a C-shaped channel of a channel beam. For example, an edge of a prefabricated wall panel may be positioned within a C-shaped channel of a channel beam. More specifically, a prefabricated panel may be positioned within C-shaped channels of two opposite channel beams, such as a top and a bottom channel beam of the support frame of the building module. In one example, each channel beam may further comprise a pair of lips that protrude towards each other from respective end sections of the pair of flanges.

The support frame may comprise a first connecting bracket that is configured to connect a steel post to a steel beam, and a second connecting bracket that is configured to connect two steel beams to each other wherein the first connecting bracket is different to the second connecting bracket.

The first connecting bracket may comprise a base plate configured to attach to the steel post. The first connecting bracket may further comprise at least a pair of bracket flanges protruding from the base plate and configured to attach to the pair of flanges of the steel beam, such as the channel beam. The first connecting bracket may be configured to fit at least partially within the C-shaped channel of the steel beam. This has the advantage that the first connecting bracket may not be visible when the steel post is connected to the steel beam. In one example, the first connecting bracket further comprises a third bracket flange configured to attach to the rectangular web of the channel beam. This may increase stability of the connection between the steel post and the steel beam.

The second connecting bracket may comprise two bracket flanges that are arranged substantially perpendicular to each other such that a first bracket flange can attach to the rectangular web of a first channel beam and a second bracket flange can attach to the rectangular web of a second channel beam. For example, the second connecting bracket may be substantially L-shaped. The second connecting bracket may further comprise a pair of recesses. The pair of recesses may be arranged at opposite side of the first bracket flange and may be configured to receive the pair of lips of the first channel beam. Furthermore, at least one of the two bracket flanges may comprise a tapered portion to guide the at least one bracket flange into the C-shaped channel of the channel beam. In some embodiments, the connecting brackets are integrally formed.

In one specific embodiment, at least one steel beam has first and second opposite end sections and has a width defined by the substantially rectangular web wherein the width tapers from the first end section to the second end section of the at least one steel beam. The at least one steel beam may be configured to form a roof support of the building module.

Specifically, the prefabricated building structure may comprise at least two steel beams, each having a tapering width, wherein the at least two steel beams are configured to attach to a roof panel of the building module. In one example, the at least one steel beam is a channel beam and has a cross-section that is C-shaped.

The plurality of prefabricated wall panels may be multi-layered panels, such as a panel comprising a core and two outer layers. The core may comprise polystyrene and the outer layers may comprise fibre cement. In one embodiment, each prefabricated wall panel comprises a plurality of longitudinally extending cavities. The cavities may be located between the outer layers of the multi-layered panels. In a specific embodiment, each prefabricated wall panel may be configured such that the longitudinally extending cavities can receive service components of the building module, including but not limited to plumbing components such as pipes and electrical components. This has the particular advantage that the service components can be concealed within the walls. In a specific example, the building module is configured such that each prefabricated wall panel is associated with one respective tie rod extending through one of the plurality of cavities.

Embodiments of the present invention relate to a method of assembling the building module described above, the method comprising:

connecting the plurality of steel posts and the plurality of steel beams using the connecting brackets to form a support frame of the building module;

positioning the plurality of prefabricated wall panels relative to the support frame, each prefabricated wall panel comprising at least one longitudinally extending cavity; and arranging a plurality of tie rods by connecting each tie rod to at least two steel beams so that the tie rod extends through a longitudinally extending cavity of a wall panel that forms a boundary wall.

BRIEF DESCRIPTION OF DRAWINGS

Certain exemplary embodiments of the invention will now be described with reference to the accompanying drawings in which.

DESCRIPTION OF EMBODIMENTS

Figure 1:
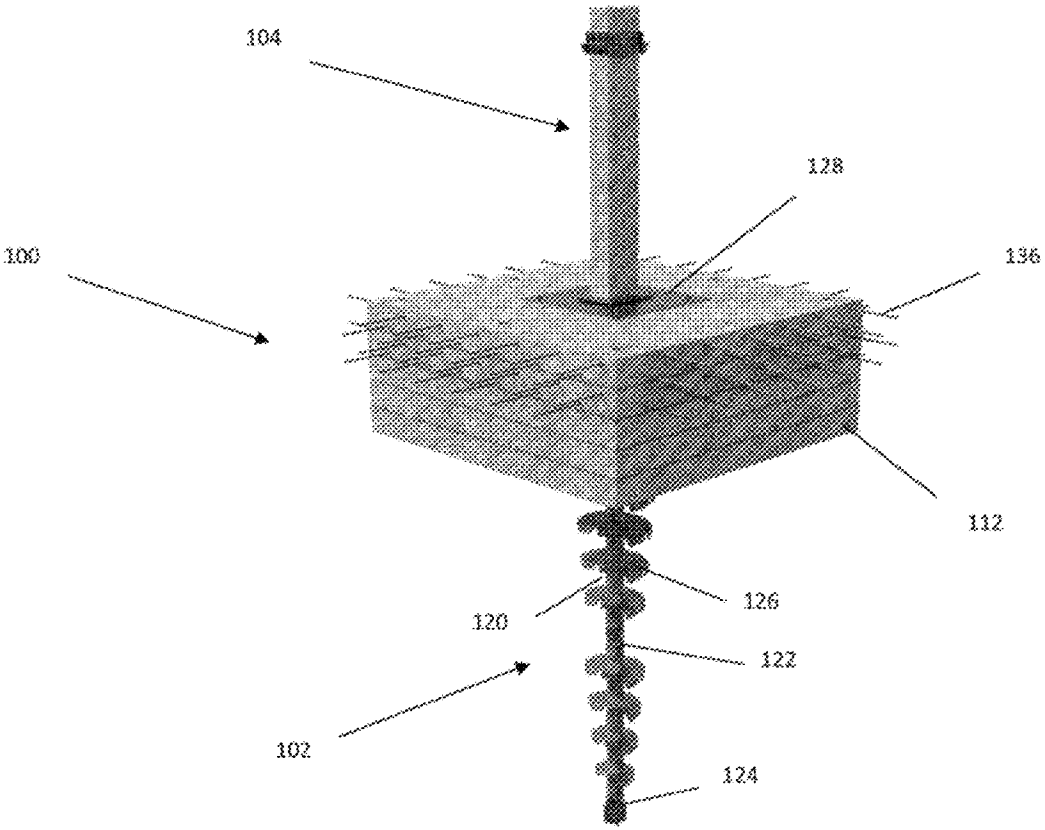
FIG. 1 is a schematic representation of a footing in accordance with an embodiment of the present invention, the footing being connected to a piling structure and a vertical column of a building structure.

The present invention generally relates to a building system comprising at least some prefabricated components. First embodiments of the present invention relate to a footing for a building structure, such as a building structure disclosed in the applicant's PCT application No. PCT/AU2015/000211 and No PCT/AU2018/050194 which are herein incorporated in their entirety by reference. Second embodiments of the present invention relate to a building module for a prefabricated building structure.

The first embodiments of the present invention generally relate to a footing for a building structure. The footing comprises a plurality of precast concrete layers, wherein each precast concrete layer comprises reinforcement bars, such as a reinforcement mesh, and a plurality of apertures. The concrete layers are typically precast before being transported to a building site where the building structure is erected. For example, wet concrete may be poured into a casting mould to make each of the concrete layers.

The reinforcement bars are typically embedded within the concrete layer, for example during the casting process. In one embodiment, steel tubes may be attached to the reinforcement bars to define respective apertures when the concrete layers are cast. The reinforcement bars may, for example, be made of steel and be in the form of a reinforcement steel mesh. However, other suitable materials are envisaged, such as glass fibre and fibre reinforced plastic.

The footing further comprises a base structure with a base plate and a plurality of alignment bars protruding from the base plate, for example, at a substantially perpendicular angle relative to the base plate surface. The footing is arranged such that when the plurality of precast concrete layers are positioned on top of one another, the plurality of alignment bars of the base structure extend through respective apertures of each precast concrete layer thereby aligning the plurality of concrete layers. This arrangement will be shown in more detail in FIGS. 1 to 9 of the accompanying drawings.

The footing in accordance with embodiments of the present invention has advantages. In particular, most or all of the footing components may be prefabricated off-site and then transported to the building site where the footing will be assembled. In some examples, assembling of the footing will be simplified as most of the components may be connected using mechanical fasteners such as bolts and threads. As such, there may be less or no need for welding at the building site to assemble the footing. Furthermore, there may be less or no need to handle wet materials, such as wet concrete when assembling the footing. In this way, it may be possible to provide most or all components of a building structure including the foundation as prefabricated components which can be assembled on-site.

Prefabricated building structures typically have components that are manufactured off-site and are transported to site for assembling the prefabricated components to erect the building structure. An example of a prefabricated building structure including prefabricated components is described in detail in the applicant's PCT application No PCT/AU2015/000211 which is herein incorporated in its entirety by reference.

Referring now to FIG. 1 of the accompanying drawings, there is shown a schematic representation of a footing 100 in accordance with an embodiment of the present invention. In the configuration shown in the Figure, the footing 100 is shown connected to a piling structure 102 and a vertical building column 104 of the building structure that is to be erected. A person skilled in the art will appreciate that a typical building structure is secured to the ground by a plurality of footings 100 and a concrete slab (not shown) which extends between the footings (thereby forming the foundation of the building structure). With regard to the piling structure 102, it will be appreciated that in some configurations, the piling structure 102 may not be necessary and the footing 100 may be positioned within a top part of the ground.

Referring now to FIGS. 2 to 7, there is shown schematic representations of components of the footing 100 of FIG. 1. The components shown in these Figures are indicative of configuration stages when the footing 100 is assembled on a building site where the building structure is erected. The footing 100 as shown in FIGS. 2 to 7 comprises a base structure 106 comprising a base plate 108 and a plurality of alignment bars 110. As particularly shown in FIG. 2, the plurality of alignment bars 110 are protruding from the base plate 108 in a substantially perpendicular angle and in a way so that the alignment bars 110 protrude upwards when the footing 100 is assembled.

Figure 4:
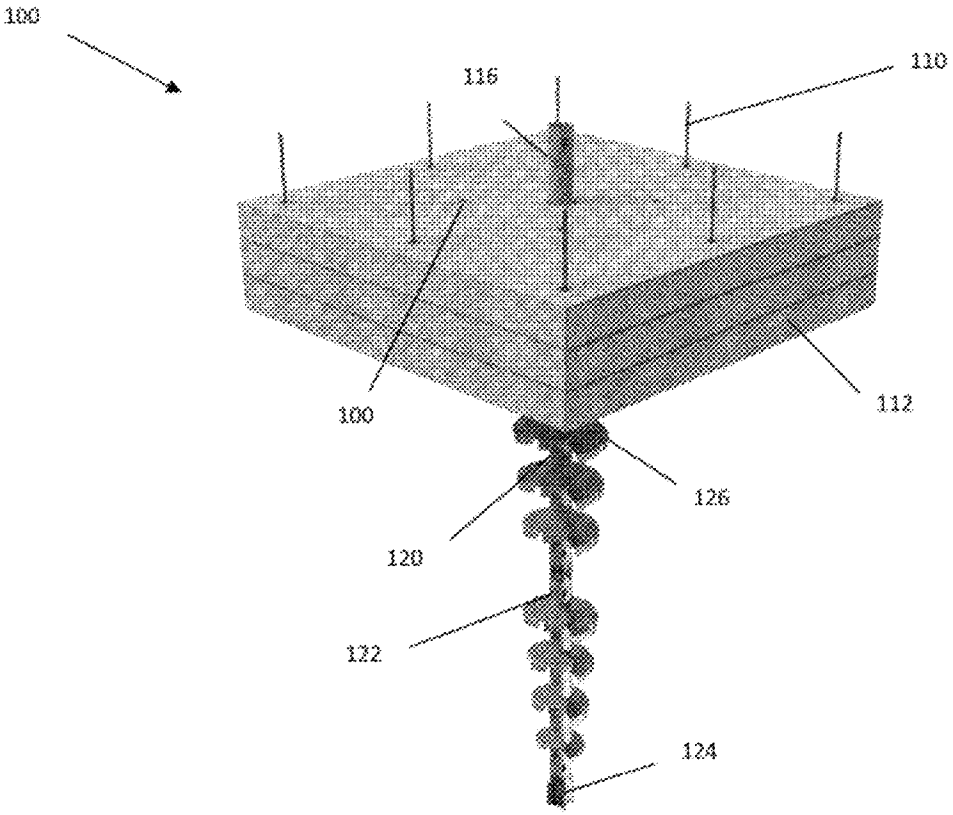
FIG. 4 is a schematic representation of the base plate of FIG. 3 with three concrete layers positioned on the base plate.
Figure 5:
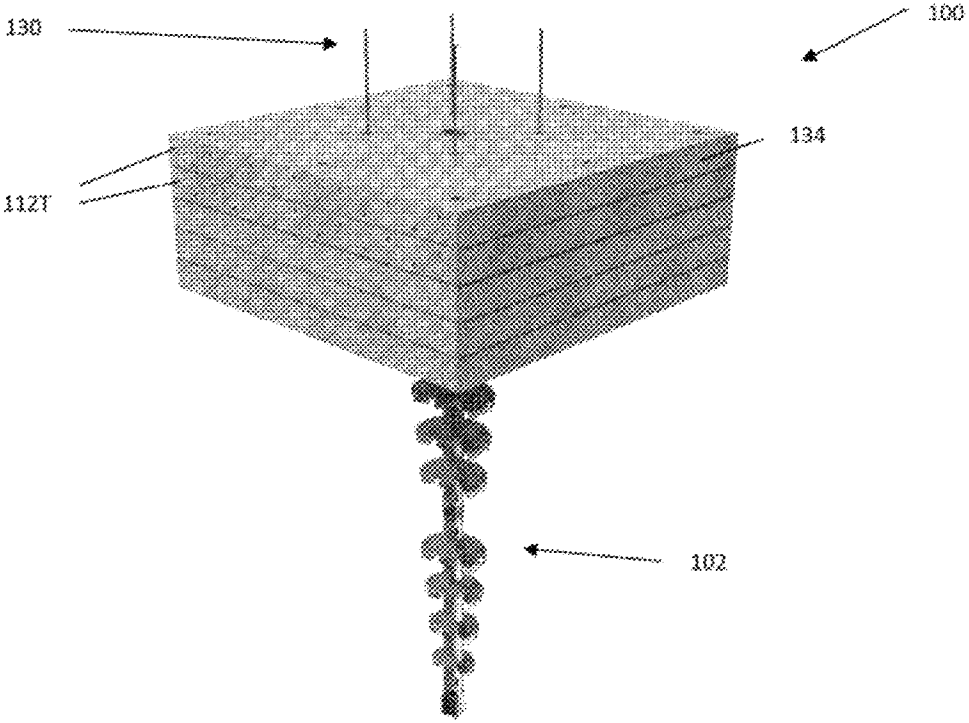
FIG. 5 is a schematic representation of the structure shown in FIG. 4 with additional concrete layers and reinforcement bars for a column plate.

The footing 100 further comprises a plurality of precast concrete layers 112 that can be positioned on top of one another as particularly shown in FIGS. 4 and 5. In this particular embodiment, the footing 100 comprises five precast concrete layers 112 that are fabricated off-site. However, any suitable number of precast concrete layers is envisaged. Due to this layered configuration of the footing 100, it is possible to transport the components of the footing 100 in a relatively compact manner. Furthermore, by providing precast concrete layers 112, there is no need for pouring wet concrete at the building site to form the footing 110.

Figure 3:
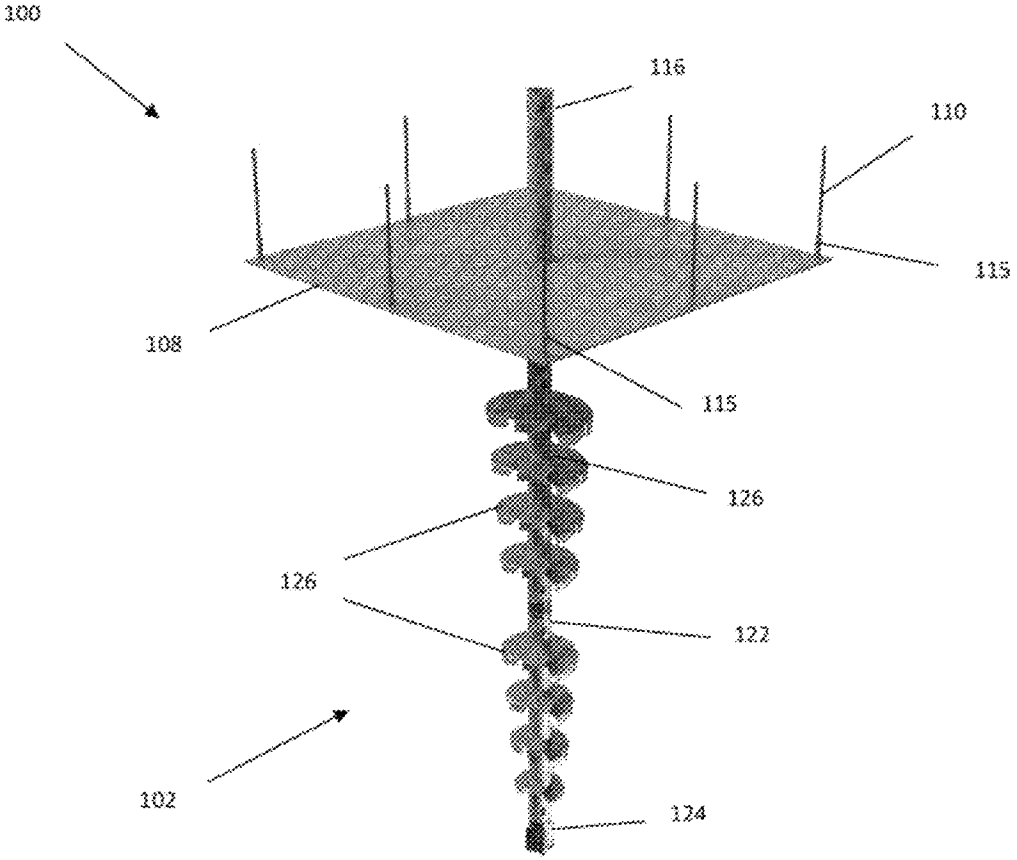
FIG. 3 is a schematic representation of the base plate of FIG. 2 including a plurality of connectors, alignment bars and a centre column.

When the plurality of precast concrete layers 112 are positioned on top of one another, the plurality of alignment bars 110 of the base structure 106 extend through matching apertures 114 in each precast concrete layer 112. In this embodiment, the base structure 106 comprises 8 alignment bars 110 positioned along corners and edges of the base plate 108 as shown in FIG. 3. With this configuration, when the plurality of precast concrete layers 112 are positioned on top of one another, the alignment bars 110 ensure that no or only minor horizontal movement of the precast concrete layers 112 is possible.

Figure 2:
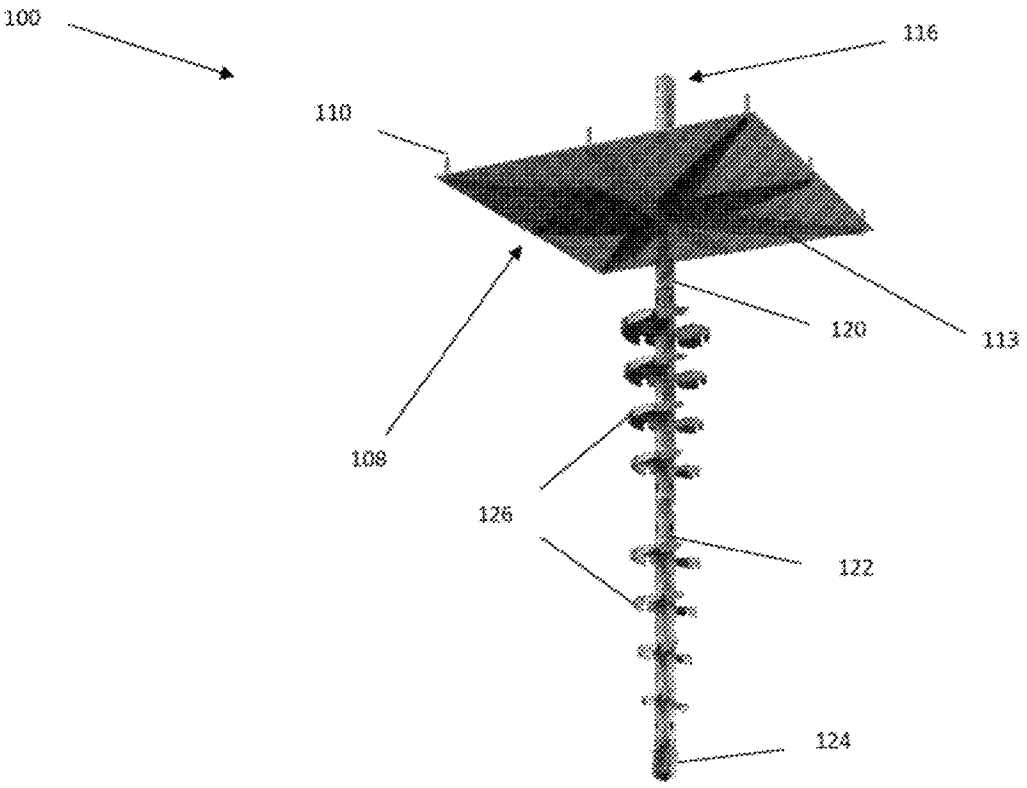
FIG. 2 is a schematic representation of a base plate of the footing of FIG. 1 coupled to the piling structure.

In this example, the alignment bars 110 are connected to the base plate 108 by virtue of connectors 115 as shown in FIGS. 2 and 3. The connectors 115 are significantly shorter in length than the alignment bars 110. In one particular example, the connectors 115 have a length substantially similar to a thickness of a precast concrete layer 112, and the alignment bars 110 have a length to match a thickness of all of the precast concrete layers 112 that make up the footing 100. Using connectors 115 instead of directly securing the alignment bars 108 to the base plate 108 has the advantage that the base structure 106 can be packed in a relatively compact manner and relatively flat compared to the assembled footing 100. This results in a simplified transportation of the prefabricated components of the footing 100 to the building site.

The connectors 115 are typically welded to the base plate 108, whereas the alignment bars 110 may be bolted to the connectors 115. However, other ways of connecting the alignment bars 110 to the base plate 106 are envisaged. In one example, the alignment bars 110 fit snugly into the connectors 115 and are grouted in, when the plurality of precast concrete layers 112 are positioned on top of one another. In addition, the connectors 115 may be threaded.

Using a plate 106 as part of the base structure of the footing 100 further has the advantage that the base plate 106 can function as a levelling point for the footing 100. In other words, when the footing 100 is positioned at the building site to be assembled, the footing 100 can be levelled by levelling the base plate 106.

In this particular example, the base plate further comprises a support structure in the form of a web 113. The web 113 is arranged at a bottom face of the base plate 106. The bottom face of the base plate 106 faces downwards when the footing 100 is positioned at the building site. Thus, the web 113 is arranged substantially opposite to the connectors 115 and the alignment bars 110. The web 113 has a plurality of web elements protruding from the base plate 106 and extending radially from a centre point of the base plate 106. In this way, the web 113 is configured such that any horizontal movement of the footing 100, such as sliding or rotating, is reduced or even prevented when the footing 100 is installed. The web 113 may further provide improved stability of the footing 100.

Referring now to FIGS. 2, 3 and 4, the footing 100 further comprises a centre column 116 that extends through a central aperture 118 of each precast concrete layer 112 and the base plate 106. The centre column 116 may be made of steel and may have a larger diameter than the alignment bars 110. Thus, the stability of the footing 100 can be increased. In this embodiment, the centre column 116 is further configured to directly secure the footing 100 to the piling structure 102 as shown in FIG. 2. For example, the centre column 116 may be welded to the piling structure 102. As will be appreciated by a person skilled in the art, the piling structure 102 may or may not form part of the footing 100. Even more so, in some configurations there may be no need for a piling structure depending on the building site. Piling structures are typically used for foundations in order to improve transfer of the load onto a suitable underlying soil stratum. Load is typically transferred to the ground through shear along a shaft of the piling structures.

The piling structure 102 in this example and shown in FIG. 2 is further connected to the base plate 106 of the footing 100. For example, the piling structure 102 may be welded to the base plate 106. The piling structure 102 is a helical pile with a blade bit attached to a blade shaft as described in detail in PCT application No. PCT/AU2015/000211. However, the piling structure may be any suitable piling structure, such as a screw pile, or a helical pile.

In the following, a short summary of the helical pile 102 is provided. The helical pile 102 comprises two shaft components 120, 122 and a blade bit 124 which may be connected to each other by locking pins or any other suitable connection. Each shaft component 120, 122 has a length of approximately three metres and comprises a series of helical bearing plates 126 that are firmly secured to the shaft components. In this particular example, each shaft component 120, 122 has four helical bearing plates attached to them. It will be appreciated that depending on a number of factors, any size of the piling structure 102 and number of helical bearing plates 126 are envisaged. The helical bearing plates 126 are typically welded to the shaft components 120, 122 and arranged to provide an overall conical shaft of the piling structure 102. The blade bit 124 has a bit body and blades that are preferably produced with one side shorter than the other and sloping out from the outer edge to create a leading edge. This may enhance the penetration ability of the piling structure 102 for a given torque.

Figure 6:
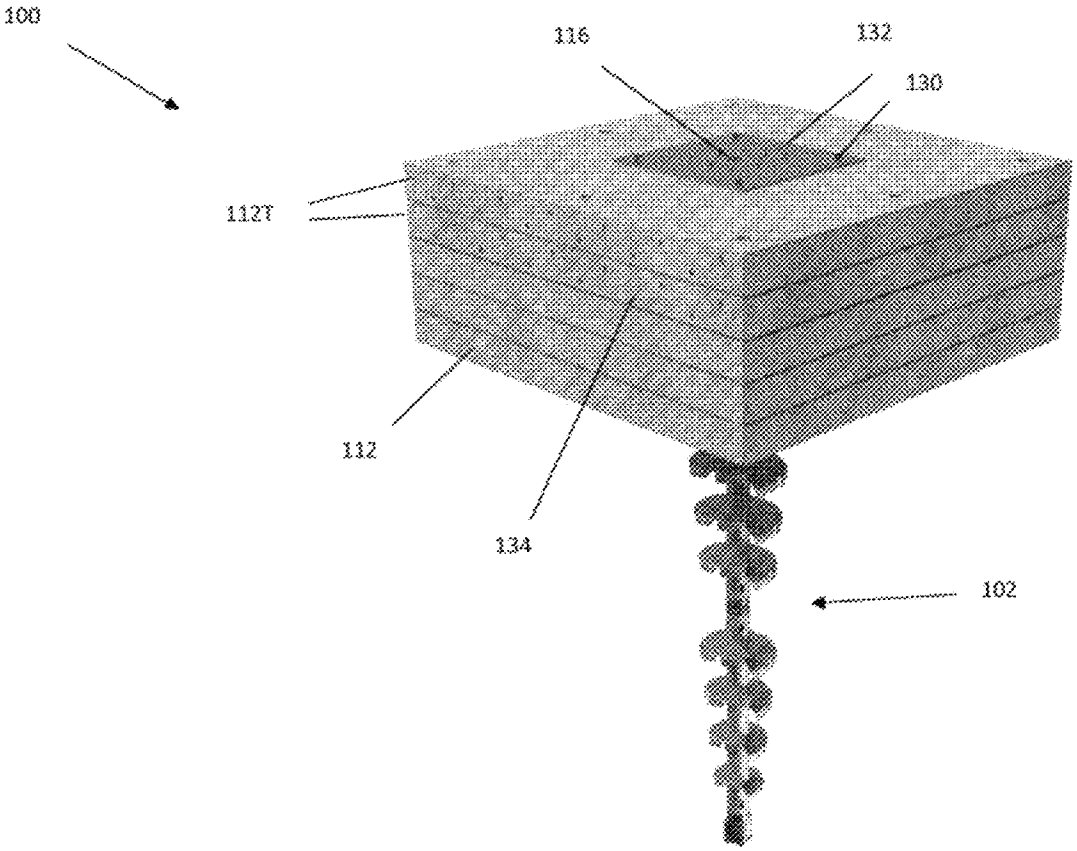
FIG. 6 is a schematic representation of the structure shown in FIG. 5 including a column plate.
Figure 7:
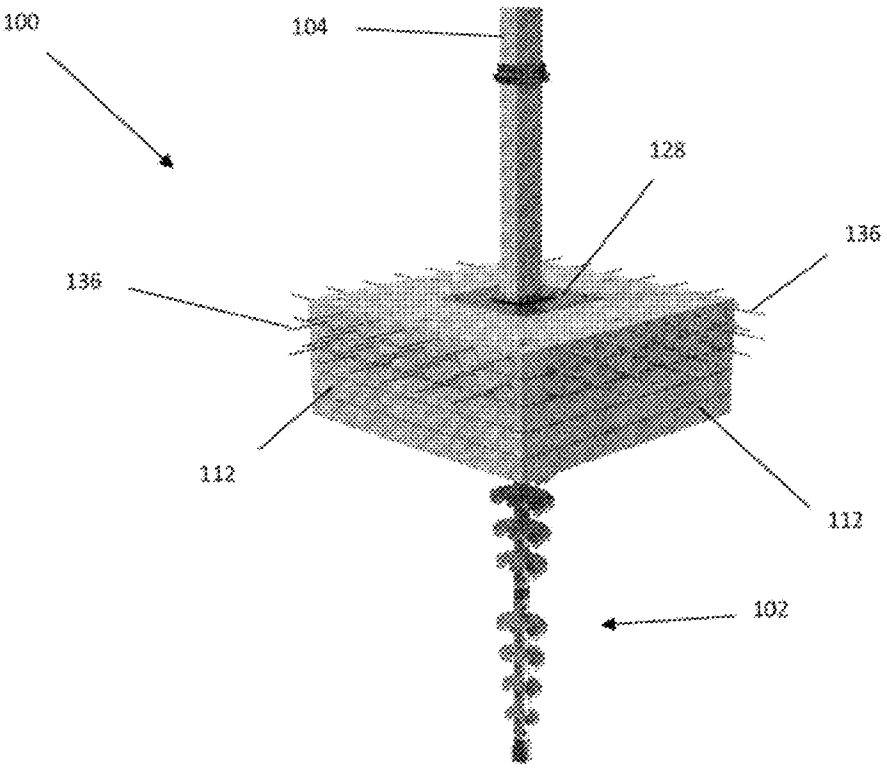
FIG. 7 is a schematic representation of the assembled footing as shown in assembling stages in FIGS. 2 to 6.

Referring now to FIG. 7, there is shown the footing 100 connected to the vertical column 104 of a building structure (not shown). In order to secure the footing 100 to the vertical column 104, the footing 100 comprises a column plate 128 that is positioned on top of the precast concrete layers 112 when all precast concrete layers 112 have been positioned on top of one another (see in particular FIG. 6). In this example, the column plate 128 is secured to some of the precast concrete layers 112 by virtue of column reinforcement bars 130 that are shown in detail in FIG. 5. In particular, two top precast concrete layers 112T comprise apertures 132 that are positioned to receive four column reinforcement bars 130. The column reinforcement bars 130 may be secured within the apertures 132 of the two top precast concrete layers 112T by virtue of grout. The column plate 128 can then be secured to the top precast concrete layer by bolting the column plate 128 to the reinforcement bars 130 as shown in FIG. 6. The apertures 132 may be formed similar to the apertures 114 for receiving the alignment bars 110. In particular, steel tubes may be attached to the reinforcement bars of each concrete layer 112 such that the steel tubes define the apertures 114, 132 to receive the respective alignment bars 114 and column reinforcement bars 130.

Referring back to FIG. 6, the column plate 128 comprises protrusions 132 that are typically welded to the column plate 128 off-site. The vertical column 104 of the building structure can then be secured to the footing 100 by bolting the column 104 to the protrusions 132. For example, the protrusions 132 may be in the form of threaded bolts such that the vertical column 104 can be secured by attaching nuts to the bolts. As such, in order to secure the vertical building column 104 to the footing 100, there may be no need for welding on the building site.

In an alternative embodiment (not shown), the vertical column 104 is connected to the plurality of precast concrete layers 112 using one or more grout tubes. In particular, one or more bars may protrude from the top precast concrete layer. The vertical column may comprise one or more longitudinally extending grout tubes that are configured to receive the one or more bars that protrude from the top precast concrete layer. Thus, when the vertical column is positioned such that the bars extend into the grout tubes, a space between the bars and the grout tubes can be filled with grout to secure the vertical column to the plurality of precast concrete layers. In order to fill the grout tubes with the setting material, each grout tube may have an inlet located at a side wall of the vertical column.

Referring back to the drawings, the footing 100 in this particular embodiment is arranged such that the vertical column 104 of the building structure is directly aligned with the centre column 116 of the footing 100 and the shaft components 120, 122 of the piling structure 102.

The two top precast concrete layers 112T may further comprise a plurality of connectors 134 arranged to receive slab reinforcement bars 136 that, in use, extend into a concrete slab formed between a plurality of footings 100. The connectors 134 may be similar to the steel tubes used for the alignment bars 110 and the column reinforcement bars 130. As such, the slab reinforcement bars 136 may also be secured to the precast concrete layers 112T by virtue of grout. A person skilled in the art will appreciate that any suitable method of securing the slab reinforcement bars 136 to at least one of the concrete layers 112 is envisaged. In one particular example, the slab reinforcement bars 136 when connected to the footing 100 are configured to extend into recesses of a precast concrete slab. When the precast concrete slab is laid between the plurality of footings, a gap between the reinforcement bars 136 and the precast concrete slab may be filled with grout to secure the foundation of the building structure.

Figure 8:
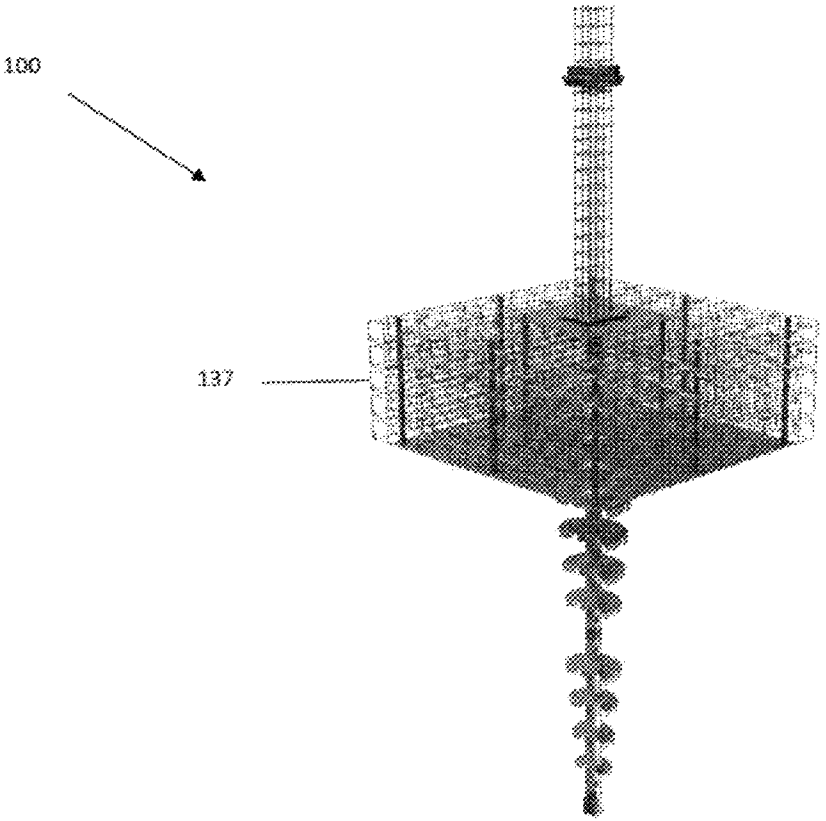
FIG. 8 is a schematic representation of the steel reinforcement of the footing in accordance with an embodiment of the present invention.
Figure 9:
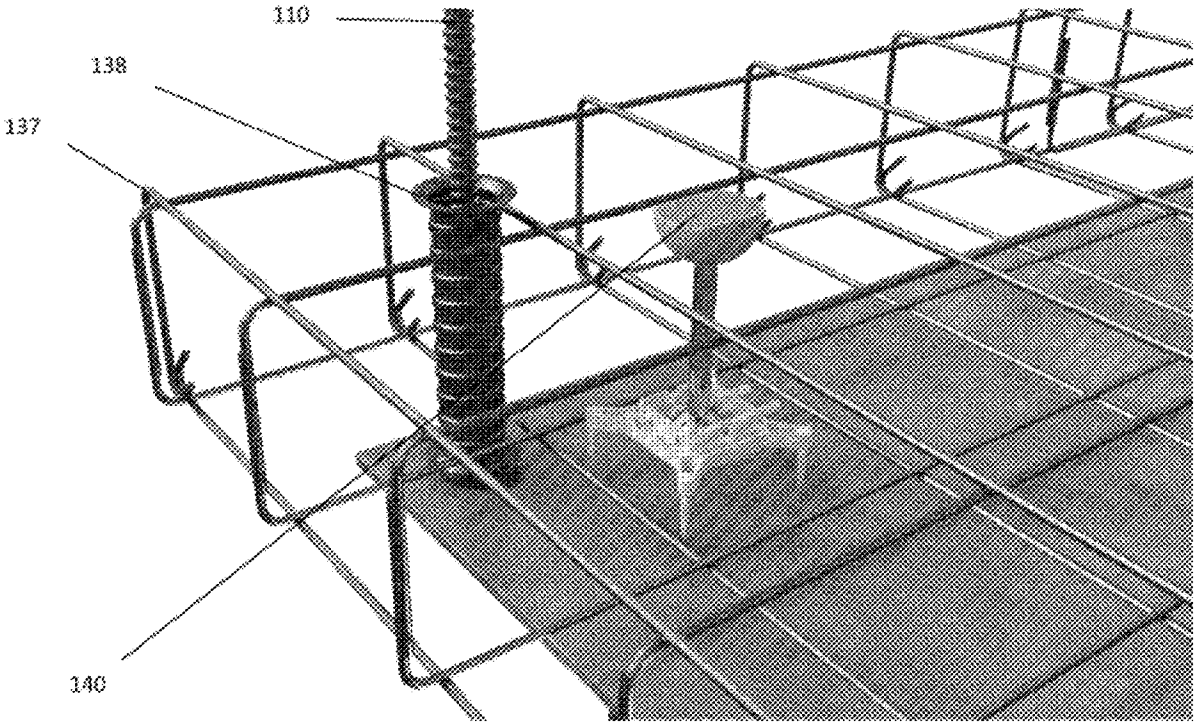
FIG. 9 is a schematic representation of a steel tube and a lifter within one of the concrete layers.

Referring now to FIG. 8, there is shown a schematic representation of the reinforcement structure within the footing 100 and the vertical building column 104. The reinforcement structure may be made of steel to provide sufficient reinforcement for a building structure that is to be erected. As can be seen in FIG. 8, each of the precast concrete layers 112 comprises reinforcement bars. In particular, the reinforcement bars are in the form of a reinforcement mesh 137 that is typically made of steel. Each precast concrete layer 112 further comprises a plurality of steel tubes attached to the reinforcement mesh 137 that are configured to define the plurality of apertures 114 or connectors 115, 134 to receive the alignment bars 110, the column reinforcement bars 130 and/or the slab reinforcement bars 136. The connectors may be threaded. One exemplary steel tube 138 is schematically illustrated in FIG. 9.

Each of the precast concrete layers 112 may further comprise one or more lifting elements 140 that are typically attached to the reinforcement mesh 137. One of such lifting elements 140 is schematically illustrated in FIG. 9. The function of the lifting elements 140 is to allow that each precast concrete layer 112 can be lifted by a lifting or handling machine, such as a crane (not shown). Such lifting elements may be embedded within a top or bottom edge of the concrete layer 112 such that a lifting or handling machine can manipulate the concrete layer 112 by attaching to the lifting elements 140. Each lifting element 140 may include a plate having a face that lies flush with a face of the top or bottom surface of the concrete layer 112. An example of these lifting elements is described in detail in PCT application No. PCT/AU2015/000211.

Each of the precast concrete layers 112 may further comprise a plurality of spacer chairs (not shown). The plurality of spacer chairs are typically connected to the reinforcement mesh such that when the reinforcement mesh is positioned on a surface, a bottom part of the mesh is spaced from the surface. This ensures that the reinforcement mesh is not visible when concrete layer 112 has been cast, i.e. when wet concrete has been poured into a casting mould. An example of a specific spacer chair for precast panels is described in detail in PCT application No. PCT/AU2015/000211.

Figure 10:
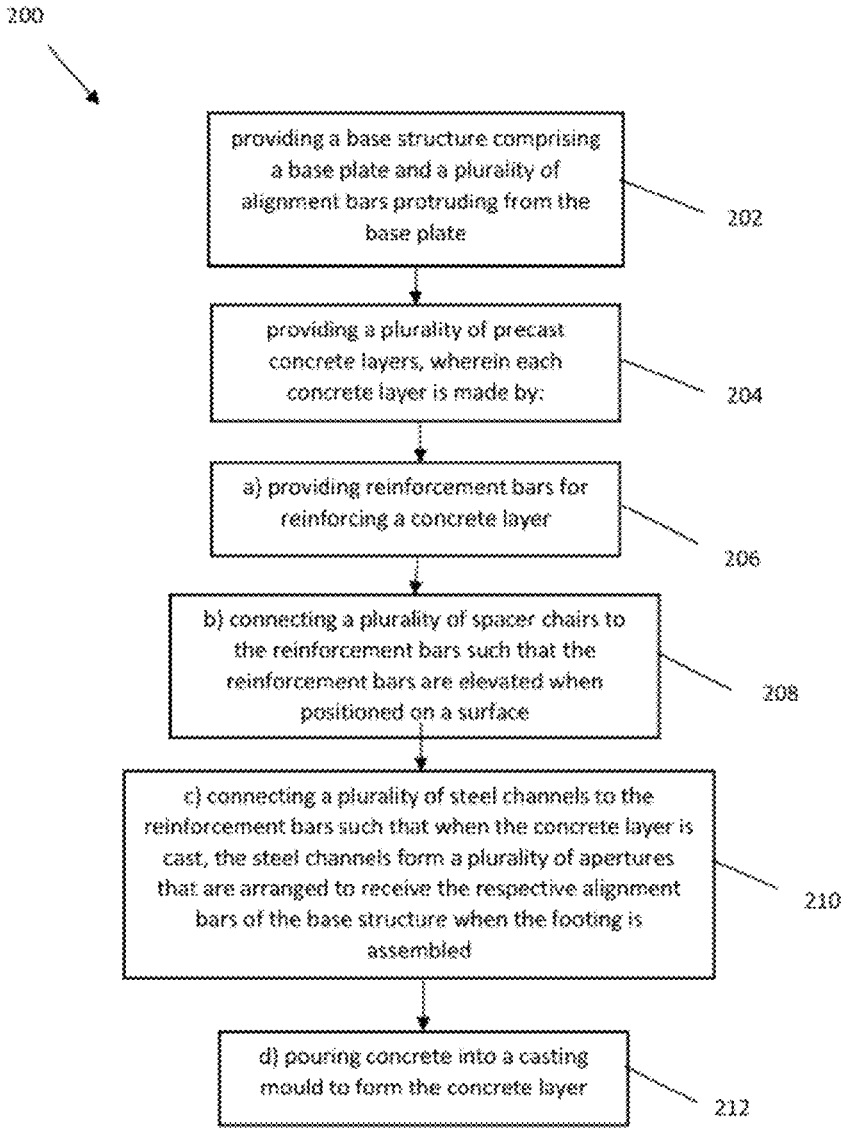
FIG. 10 is a flow chart illustrating a method of making a footing for a building structure in accordance with an embodiment of the present invention.

Referring now to FIG. 10 of the accompanying drawings, there is shown a flow chart illustrating a method 200 of making a footing for a building structure, such as footing 100 in accordance with an embodiment of the present invention. The method may comprise a step of providing 202 a base structure, such as base structure 106, comprising a base plate and a plurality of alignment bars protruding from the base plate. In a further step 204, a plurality of precast concrete layers are provided, wherein each concrete layer is made by:

a) providing (206) reinforcement bars for reinforcing a concrete layer;

b) connecting (208) a plurality of spacer chairs to the reinforcement bars such that the reinforcement bars are elevated when positioned on a surface;

c) connecting (210) a plurality of steel tubes to the reinforcement bars such that when the concrete layer is cast, the steel tubes form a plurality of apertures that are arranged to receive the respective alignment bars of the base structure when the footing is assembled; and d) pouring (212) concrete into a casting mould to form the concrete layer.

Thus, the method in accordance with embodiments of the present invention provides a plurality of separate prefabricated components that can be assembled on the building site where the building is erected. The prefabricated components are typically configured so that the separate components of the footing can be transported in a relatively compact manner.

When the separate components of the footing have been transported to the building site where the building is erected, the following method of assembling the footing in accordance with an embodiment of the present invention may be employed. In particular, the method may comprise a step of positioning a base structure at the building site, such as within a trench in the ground. The base structure comprises at least a base plate and a plurality of alignment bars protruding from the base plate. Optionally, the base structure may further comprise a centre column as described above. The method may further comprise a step of providing a plurality of precast concrete layers, wherein each precast concrete layer comprises reinforcement bars and a plurality of apertures. The plurality of precast concrete layers are then positioned on top of one another such that the plurality of alignment bars of the base structure extend through respective apertures of each precast concrete layer.

Assembling the footing may only form one part of a method of forming a foundation of the building structure. A method of forming the foundation in accordance with an embodiment of the present invention may comprise a step of providing a footing, such as footing 100. The method may further comprise a step of securing a piling structure, such as piling structure 102, to the base plate of the footing. In a further step, the piling structure and the base plate may be positioned at a building site where the building structure is erected. For example, the piling structure and the footing may be positioned in an excavated trench onsite where the building structure is erected. In a further step, the plurality of precast concrete layers of the footing are positioned on top of one another such that the plurality of apertures of each precast concrete layer receive respective alignment bars of the base structure. A vertical column of the building structure may then be secured to the footing, for example by virtue of a column plate, such as column plate 128.

Second embodiments of the present invention generally relate to a building module for a prefabricated building structure having components that are fabricated off-site and transported to a building site where the building structure can be assembled. The building structure may have one or more building modules that may have different sizes in length, width and height. The building modules may be connected horizontally or vertically, for example, to form a two-storey building.

A building module in accordance with embodiments of the present invention generally comprises a plurality of prefabricated wall panels wherein each prefabricated wall panel comprises at least one longitudinally extending cavity. The building module further comprises a support frame having separable parts which comprises a plurality of steel posts, a plurality of steel beams and a plurality of connecting brackets that are arranged to connect the plurality of steel posts and the plurality of steel beams to form the support frame. The building module also comprises a plurality of tie rods wherein each tie rod is configured to connect two steel beams with each other, such as top and bottom steel beams that extend substantially horizontally. The tie rods may be connected to the steel beams, such that the tie rods are under tension. The building module is configured such that each tie rod extends through a longitudinally extending cavity of at least a wall panel that forms a boundary wall. The plurality of prefabricated wall panels, the separable parts of the support frame and the plurality of tie rods are configured to be stackable such that a volume of the building module can be minimised for transporting the building module to a building site.

Thus, prefabricated components of the building module, including the prefabricated wall panels, the support frame and the tie rods, can be broken down into their smallest portable package for transporting the building module. Components of the building module may be packaged in at least one transport pack. In one example, the components are packaged in a plurality of transport packs. The transport pack may be in the form of a "flat pack" that is flat relative to a size of the building module when the building module is erected.

Figure 11:
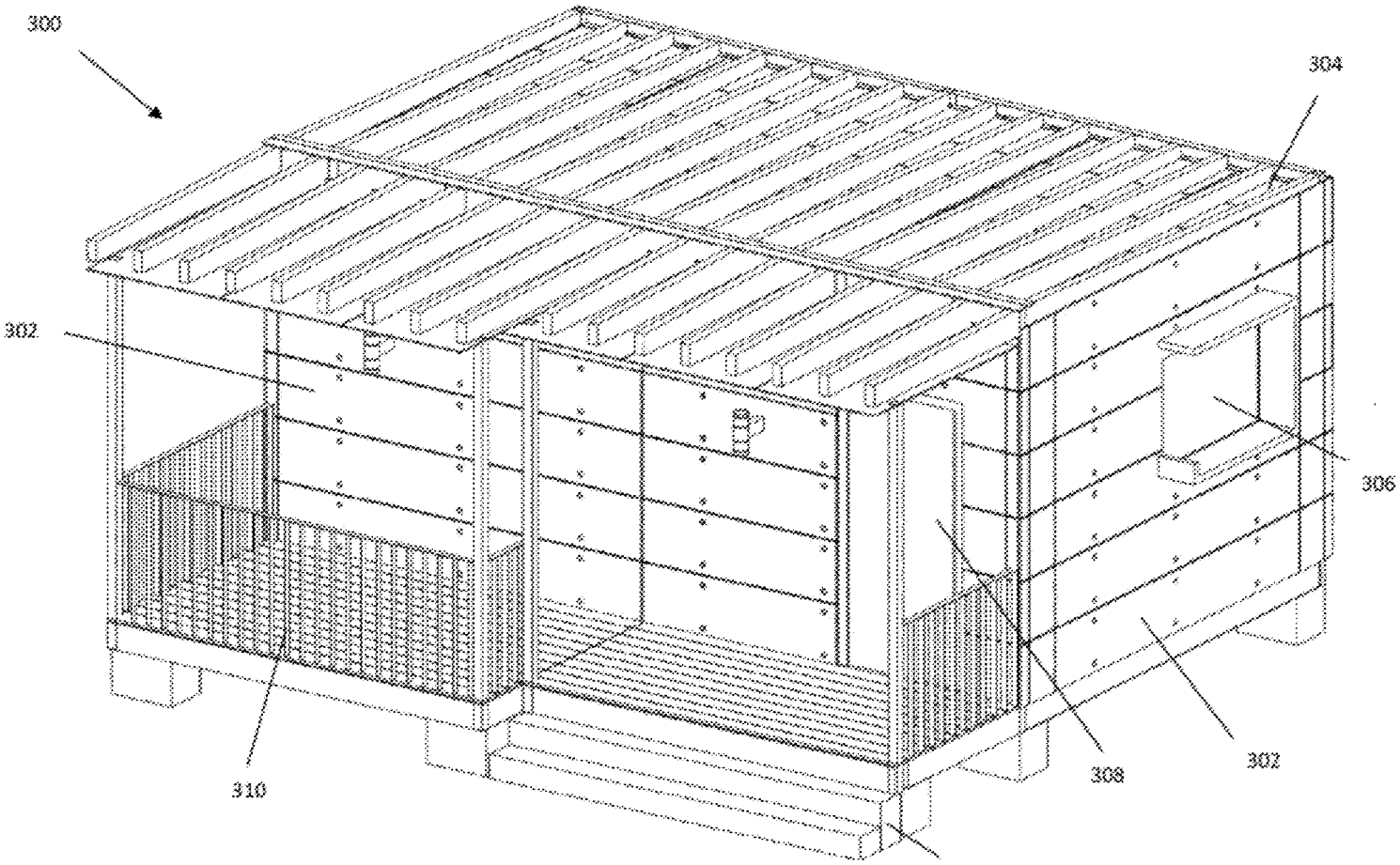
FIG. 11 is a schematic representation of a building structure in accordance with an embodiment of the present invention.

Referring now to FIG. 11, there is shown a schematic representation of an exemplary building structure 300 comprising one building module. However, it will be appreciated that a building structure may comprise multiple building modules connected to each other. The building structure 300 comprises a support frame 400 as shown in detail in FIG. 12 and a plurality of prefabricated panels. Some of the prefabricated panels form wall panels 302 of the building structure 300, other prefabricated panels may form roof panels 304 and flooring panels (not shown). In this example, the prefabricated wall panels 302 are multi-layered panels having a core 320 and outer layers 322, 324 as shown in further detail in FIG. 13. The core 320 may, for example, be made of polystyrene and the outer layers 322, 324 may be made of fibre cement. The polystyrene core 320 may offer insulation while the outer fibre cement layers 322, 324 may offer substantial load bearing capacity by virtue of their thickness. Another example of a prefabricated wall panels 302 is described in PCT application No. PCT/AU2015/000211 which is herein incorporated in its entirety by reference.

Figure 13:
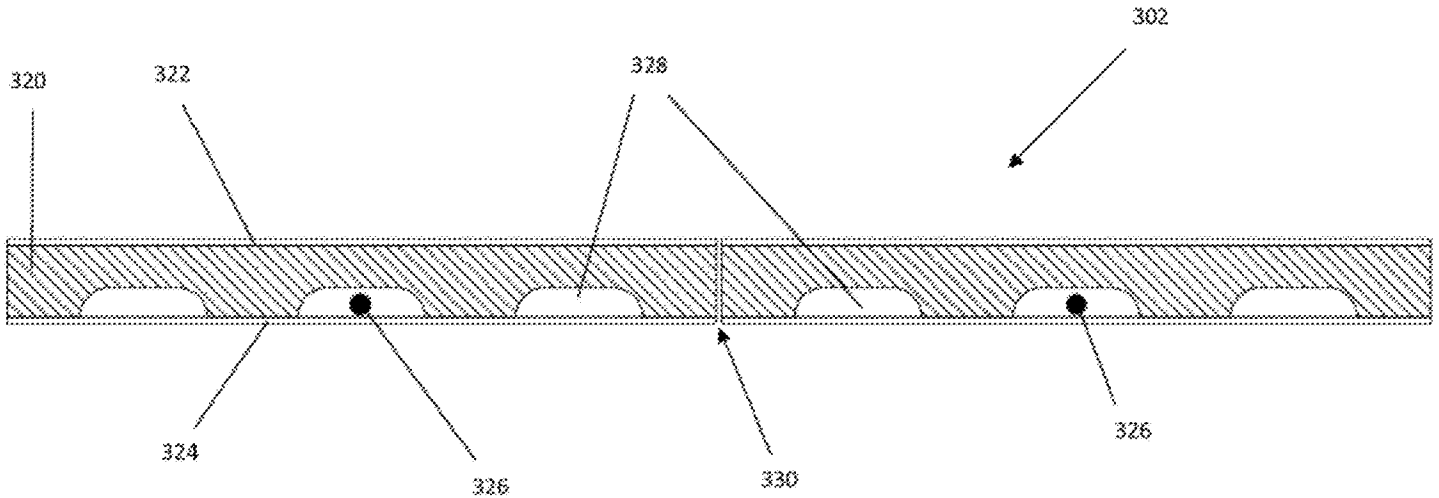
FIG. 13 is a top view of a prefabricated wall panel of the building structure of FIG. 11.

The prefabricated wall panels 302 may be at least partially secured to the support frame 400 of the building structure 300 by virtue of the tie rods 326 that are illustrated in FIG. 13. Specifically, each wall panel 304 may have one or more cavities 328 extending along a height of the wall panel 304. Tie rods 326 may extend through one of these cavities 328 and be secured to top and bottom channel beams that are part of the support frame shown in FIG. 13. In this way, wall panels 302 may only need to be secured to the support frame 400. In addition to the tie rods 328, adjacent wall panels 302 may be arranged in abutment to each other and a space 330 between the abutment faces may be filled with glue or the like However, other methods of securing the wall panels 302 to the support frame 400 or to one another are envisaged.

A person skilled in the art will appreciate that a similar construction can be applied to other prefabricated panels forming, for example, floor panels or roof panels.

Figure 12:
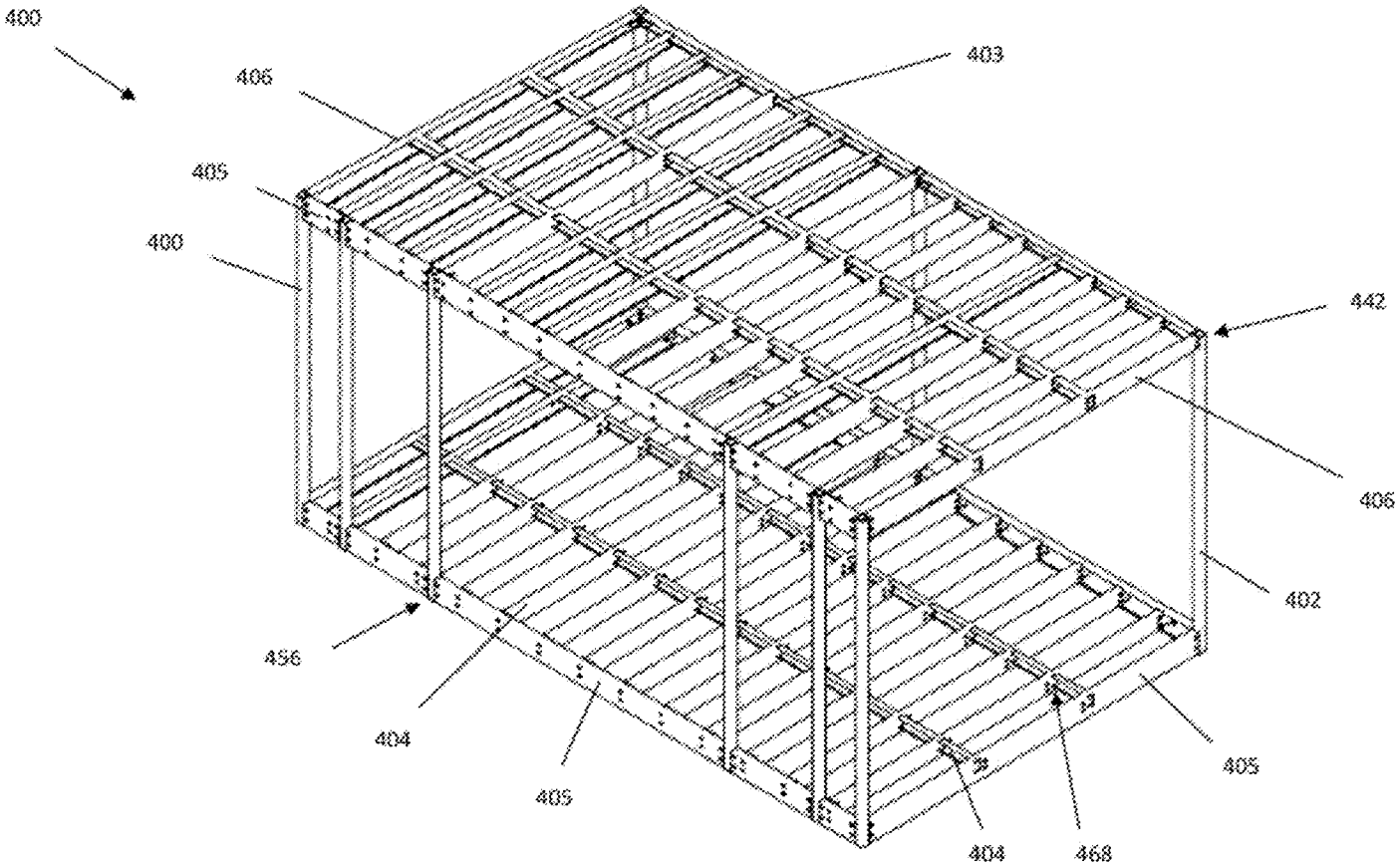
FIG. 12 is a schematic representation of a support frame of the building structure of FIG. 11.

As mentioned above, the prefabricated wall panel 304 comprises more than one cavity extending along a height of the panel as shown in FIG. 12. Other cavities or spaces may be used to accommodate additional tie rods and/or parts of an electrical system or a plumbing system of the prefabricated building structure. In this way, these parts can be hidden away within the wall panel 304 and may not be visible from the outside or inside of the building structure 300.

Referring back to FIG. 11, in this particular example, the building structure 300 further comprises a window 306 and a door 308. These structures have been accounted for in the support frame 400 as shown in FIG. 13. Specifically, two steel posts of the support frame form part of a door frame of the door 308. The building structure 300 further comprises a fenced terrace 310 and stairs 312 leading to the door 308 of the building structure 300. This exemplary building structure 300 has been shown in FIG. 11 to demonstrate that any suitable building structures can be included in a building module. In this way, the building structure 300 can be modified to meet the customer's needs and preferences.

Referring now to the support frame 400 as shown in FIG. 12. Once the support frame 400 is assembled, components of the building module may be attached to the support frame 400, for example, using mechanical fasteners. The components may comprise a plurality of prefabricated wall panels, one or more flooring panels, one or more roof panels, external cladding, internal cladding, windows and doors and the like.

The support frame 400 has a plurality of separable parts that may be stackable. In particular, the support frame 400 comprises a plurality of steel posts 402 that extend vertically to form vertical columns of the building structure 300. The support frame 400 further comprises a plurality of structural channel beams 403, 404, 405, 406 having different widths. However, a person skilled in the art will appreciate that other steel beams are envisaged that are suitable to form a support frame of a building structure.

Figure 14B:
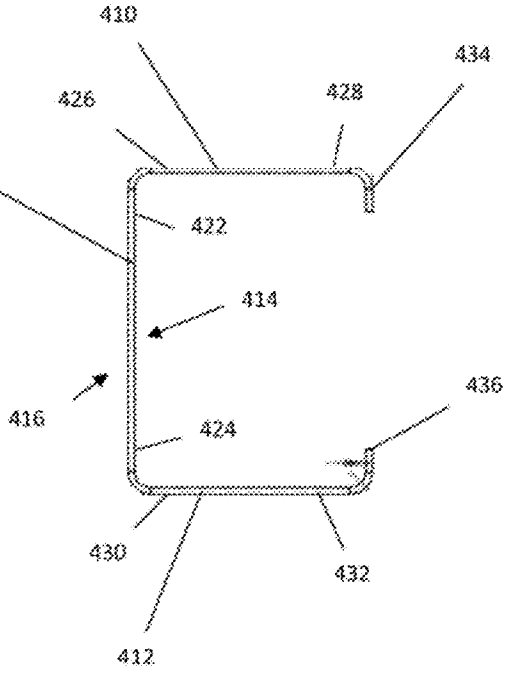
FIGS. 14A and 14B are schematic representations of a channel beam of the support frame of FIG. 12.
Figure 14A:
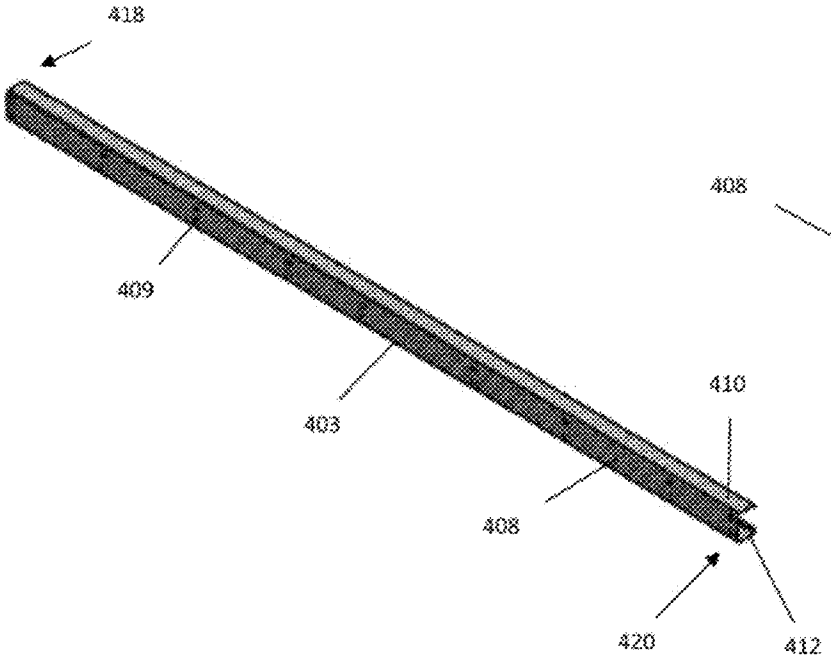

One exemplary channel beam 403 is shown in a schematic representation in FIGS. 14A and 14B. Specifically, the channel beam 403 comprises a substantially rectangular web 408 that defines a longitudinal axis of the channel beam 403. In this particular example, the web 408 comprises 9 pairs of apertures 409 that are positioned to receive bolts (not shown) such that the channel beam 403 can be connected to other structures, such as steel posts and other channel beams using connecting brackets. The channel beam 403 further comprises a pair of flanges 410, 412 protruding from the rectangular web 108. In this particular example, the pair of flanges 410, 412 extend substantially perpendicular to the web 408.

More specifically, the web 408 comprises an inner planar surface 414, an outer planar surface 416, a first end 418, a second end 420, a first side 422 and a second side 424. The longitudinal axis of the channel beam 403 extends between the first and second ends 418, 420. The first flange 410 has an inner side 426 that is directly connected to the first side 422 of the web 408 and an outer side 428. The first flange 410 extends substantially between the first and second ends 418, 420 of the web 408. The second flange 412 also has an inner side 430 and an outer side 432. The inner side 430 is directly connected to the second side 424 of the web 408 and extends substantially between the first and second ends 418, 420 of the web 408. As such, the first and second flanges 410, 412 extend substantially parallel to each other. In this particular example, the pair of flanges 410, 412 is integrally formed with the web 408.

The channel beam 403 further comprises a first lip 434 and a second lip 436 that extend in substantially the same plane. Specifically, the first lip 434 extends substantially perpendicular to the first flange 410 and substantially parallel to the web 408. The first lip 434 is connected to the outer side 428 of the first flange 410 and extends substantially between the first and second ends 418, 420 of the web 408. The second lip 436 extends substantially perpendicular to the second flange 412 and substantially parallel to the web 408. The second lip 436 is connected to the outer side 432 of the second flange 412 and also extends substantially between the first and second ends 418, 420 of the web 408. Both first and second lips 434, 436 may be integrally formed with the respective flanges 410, 412. Thus, the channel beam 403 is configured such that a C-shaped channel is formed along the longitudinal axis, defined by inner surfaces of the rectangular web 408, the pair of flanges 410, 412 and the first and second lips 434, 436. Such channel beam may also be referred to as a purlin in the technical field of the invention. The channel beam 403 shown in FIGS. 14A and B has a width of 10.2 cm which is defined by a width of the rectangular web 408. Each flange 410, 412 has a length of 7.6 cm and each lip 434, 436 has a length of 1.4 cm. A person skilled in the art will appreciate that any dimensions specified in this specification are exemplary only.

Referring back to FIG. 12, the support frame 400 in this example has 9 vertical steel posts 402. Each steel post 402 has a substantially square cross section and opposite first and second ends 438, 440. In this example, each steel post 402 has a length of approximately 3 m which defines a height of the building structure 300. However, it will be appreciated that the support frame 400 may only form one of a plurality of levels of a building structure. A specific example of a building system having multiple levels is described in patent application No. PCT/AU2018/050194 which is herein incorporated in its entirety by reference.

As mentioned above, the channel beams 403, 404, 405, 406 have different widths and different lengths as shown in FIG. 12. In this specification, like numbers are used to identify channel beams having the same width, however they may differ in lengths.

Figure 15A:
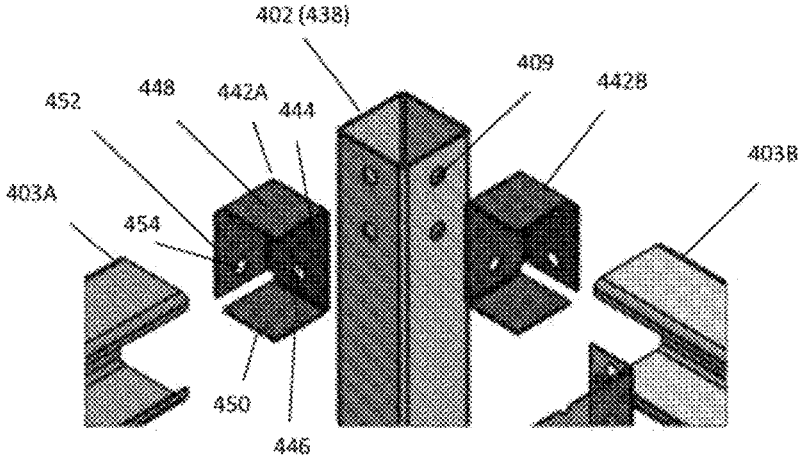
FIGS. 15A and 15B are schematic representations of a steel post of the support frame of FIG. 12, connected to two channel beams using first connecting brackets.
Figure 15B:
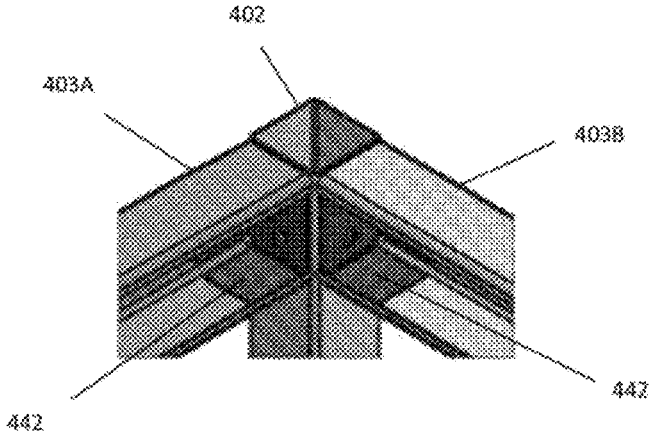

A first end 438 of the steel post 402 is connected to the channel beam 403 having a width of approximately 10 cm by virtue of a first connecting bracket 442 (not visible in FIG. 12). An exemplary representation of this connection is shown in FIGS. 15A and 15B. FIG. 15A shows the steel post 402, two channel beams 403A, 403B and two first connecting brackets 442A, 442B as separate parts before the steel post 402 is connected to the two channel beams 403A, 403B. FIG. 15B shows a configuration in which the steel post 402 is connected to the two channel beams 403A, 403B. This configuration is also shown in FIG. 12. In this configuration, the first connecting brackets 442A, 442B are positioned within the C-shaped channels of the channel beams 403A, 403B and therefore not visible from an outside view of the support frame 400.

The first connecting bracket 442 comprises a base plate 444 that is configured to attach to the first end 438 of the steel post 402. Specifically, the base plate 444 comprises a pair of apertures 446 that is positioned to match a pair of apertures 409 of the steel post 402 such that the first connecting bracket 442 can be connected to the steel post 402 using mechanical fasteners, such as bolts. The first connecting bracket 442 further comprises a first bracket flange 448 and a second bracket flange 450 that both extend substantially perpendicular from the base plate 444. The first and second bracket flanges 448, 450 extend substantially parallel to each other and are configured to attach to the first and second flanges 410, 412 of the channel beam 403, respectively. In this particular example, the first and second bracket flanges 448, 450 do not have any structure to fasten the flanges directly to the channel beam 403. However, it is envisaged that the first and second bracket flanges 448, 450 may also comprise structures to fasten the flanges directly to the channel beam 403, such as apertures to receive bolts similar to the base plate 444.

In this particular example, the first connecting bracket 442 comprises a third bracket flange 452 that is connected to the base plate 444 and that extends substantially perpendicular to the base plate 444. The third bracket flange 452 extends substantially perpendicular to the first and second bracket flanges 448, 450. Thus, the first connecting bracket 442 has an overall substantial cubical shape.

In this example, the third bracket flange 452 is not directly connected to the first and second bracket flanges 448, 450. However, a direct connection between the third bracket flange 452 and the first and second bracket flanges 448, 450 is envisaged. The third bracket flange 452 comprises a pair of apertures 454 so that the third bracket flange 452 can be bolted to the channel beam 403. It will be appreciated that the third bracket flange 452 is an optional feature of the first connecting bracket 442 and may be omitted.

In this example, the three bracket flanges 448, 450, 452 are integrally formed with the base plate 444. As shown in particular in FIG. 15B, the first connecting bracket 442 is configured such that the first and second bracket flanges 448, 450 can slide into channels defined by the first and second flanges 410, 412 of the channel beam 403. Thus, the entire first connecting bracket 442 can be positioned within the C-shaped channel of the channel beam 403 when the channel beam 403 is connected to the steel post 402 as shown in particular in FIG. 15B.

Figure 16A:
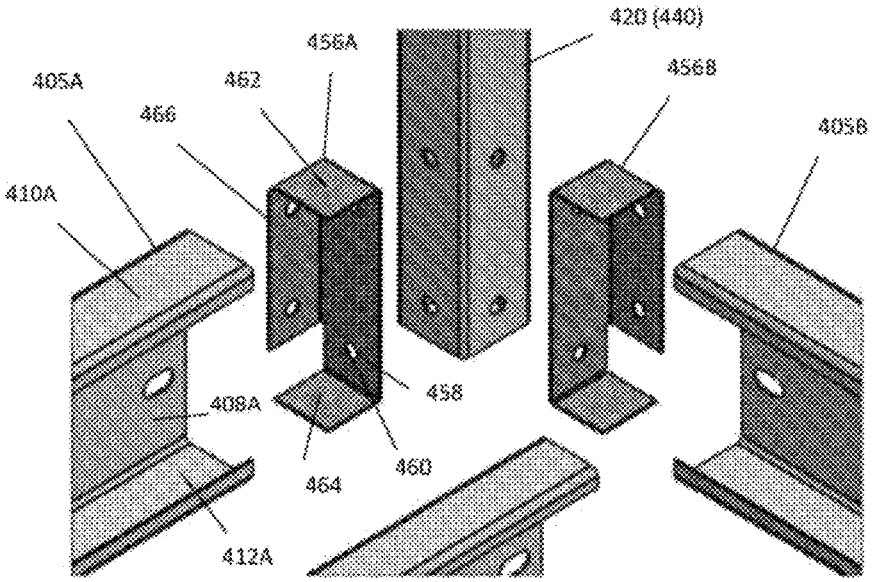
FIGS. 16A and 16B are schematic representations of a steel post of the support frame of FIG. 12, connected to two channel beams using second connecting brackets.
Figure 16B:
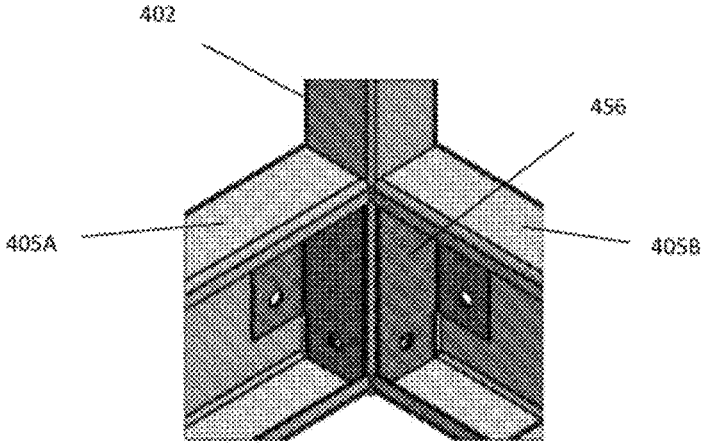

Referring now to FIGS. 16A and 16B there is illustrated a connection between a steel post 402 and a channel beam 405 having a width of approximately 20 cm. The steel post 402 is connected to two channel beams 405 by virtue of second connecting brackets 456. Similar to FIGS. 15A and 15B, FIG. 16A shows the steel post 402, the two channel beams 405A, 405B and the two second connecting brackets 456A, 456B as separate parts before the steel post 402 is connected to the two channel beams 405A, 405B. FIG. 16B shows a configuration in which the steel post 402 is connected to the two channel beams 405A, 405B. This configuration is also shown in FIG. 12. In this configuration, the second connecting brackets 456A, 456B are positioned within the C-shaped channels of the channel beams 405A, 405B and therefore not visible from an outside view.

The second connecting bracket 456 has a similar configuration as the first connecting bracket 442 with a difference in dimensions to accommodate the larger width of the channel beam 405. In short, the second connecting bracket 456 also comprises a base plate 458 with a pair of apertures 460 for receiving fasteners to fasten the second connecting bracket 456 to the steel post 402. Further, the second connecting bracket 456 comprises first, second and third bracket flanges 462, 464, 466 that are integrally formed with the base plate 458. The second connecting bracket 456 is configured to fit into the C-shaped channel of the channel beam 405. The overall shape of the second connecting bracket 456 is a substantial rectangular prism.

Figure 17A:
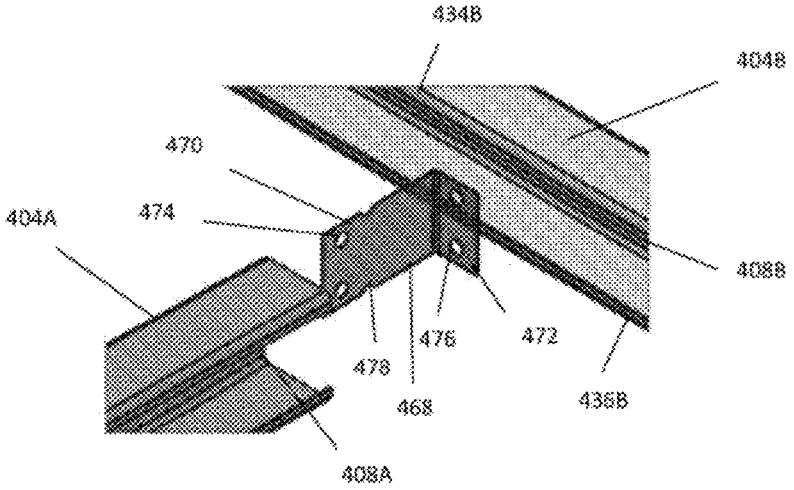
FIGS. 17A and 17B are schematic representations of a first channel beam of the support frame of FIG. 12 connected to a second channel beam using a third connecting bracket.
Figure 17B:
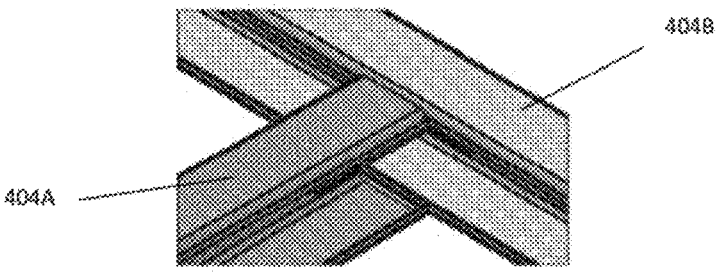

Referring now to FIGS. 17A and 17B there is shown a schematic representation of a connection between two channel beams 404A, 404B having the same width (approximately 15 cm). In this example, the two channel beams 404A, 404B are connected using a third connecting bracket 468. Similar to FIGS. 15A and 15B, FIG. 17A shows the two channel beams 404A, 404B and the third connecting bracket 466 as separate parts before the two channel beams 404A, 404B are connected to each other. FIG. 17B shows a configuration in which the two channel beams 404A, 404B are connected to each other. This configuration is also shown in FIG. 12. In this configuration, the third connecting bracket 468 is positioned within the C-shaped channels of the channel beams 404A, 404B and therefore not visible from an outside view.

The third connecting bracket 468 has an overall substantial L-shape and comprises first and second bracket flanges 470, 472 which may be integrally formed. The second bracket flange 472 extends substantially perpendicular to the first bracket flange 470 and has a length that is significantly shorter than a length of the first bracket flange 470. Each of the first and second bracket flanges 470, 472 has a pair of apertures 474, 476 for receiving suitable fasteners such as bolts. In this way, the first bracket flange 470 can be directly attached to the web 408A of the first channel beam 404A and the second bracket flange 472 can be directly attached to the web 408B of the second channel beam 404B.

The third connecting bracket 468 further comprises a pair of recesses 478 that is arranged on opposite sides of the first bracket flange 470. The pair of recesses 478 is arranged to receive first and second lips 434B, 436B of the second channel beam 404B. As will be appreciated by the person skilled in the art, the pair of recesses 478 may be an optional feature depending on a width of the second bracket flange 472 or if the channel beam 404 does not have protruding lips 434A, 434B. Furthermore, the first bracket flange 470 may have a tapered portion (not shown) to guide the first bracket flange 470 of the third connecting bracket 468 into the C-shaped channel of the first steel beam 404A.

The connecting brackets 442, 456, 468 may typically be made of steel or a steel composition. However, other materials are envisaged that are suitable to form a support frame for a prefabricated building structure. Thus, by using the connecting brackets as described above, it may be possible to assemble the support frame 400 using mechanical fasteners, such as nuts and bolts. As such, there may be less or no need for welding any parts of the support frame and a need for skilled workers or specialised machinery at the building site may be reduced or even eliminated.

Figure 18A:
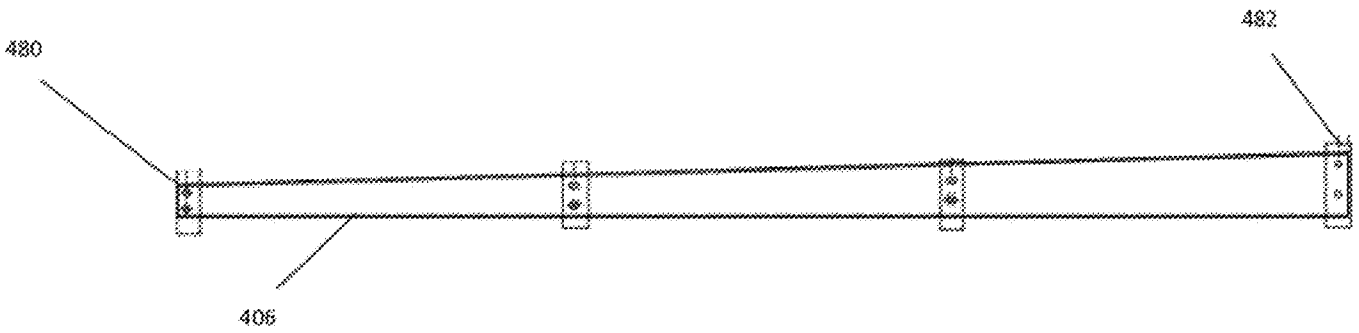
FIGS. 18A, 18B and 18C are schematic representations of a channel beam forming a roof support of the building structure of FIG. 11.
Figure 18C:
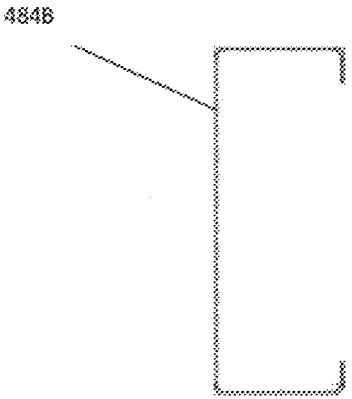
Figure 18B:
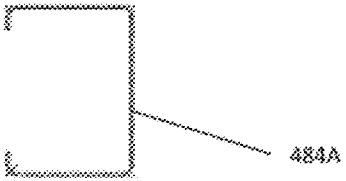

Referring back to FIG. 12, the support frame 400 comprises a plurality of channel beams 406 forming a roof support. An exemplary channel beam 406 that is configured to form a roof support is shown in FIGS. 18A, 18B and 18C. Specifically, the channel beam 406 has a first end section 480 and a second end section 482 and a substantially rectangular web 484 with gradually increasing width from the first end section 480 towards the second end section 482. Similar to channel beams 403, 404 and 405, the channel beam 406 has a cross section that is substantially C-shaped as shown in particular in FIGS. 18B and 18C. The cross section at the first end section 480 has a width 484A that is shorter than a width 484B of the cross section at the second end section 482. Specifically, the cross section increases from having a web with a width 484A of approximately 10 cm as shown in FIG. 6B to a web with a width 484B of approximately 20 cm as shown in FIG. 18C.

Having channel beams with tapering widths that are configured to form a roof support, such as channel beam 406, has significant advantages. In particular, roof panels may be directly attached to the channel beams 406 without the need for further structures to elevate one side of the roof. Thus, complexity of assembling the building structure may be significantly reduced. Furthermore, a number of prefabricated components of the building structure may be reduced which as a result may be more cost effective. A roof that is elevated on one side has the advantage that rain is directed to the lower side of the roof where it can flow off the building structure.

Figure 19:
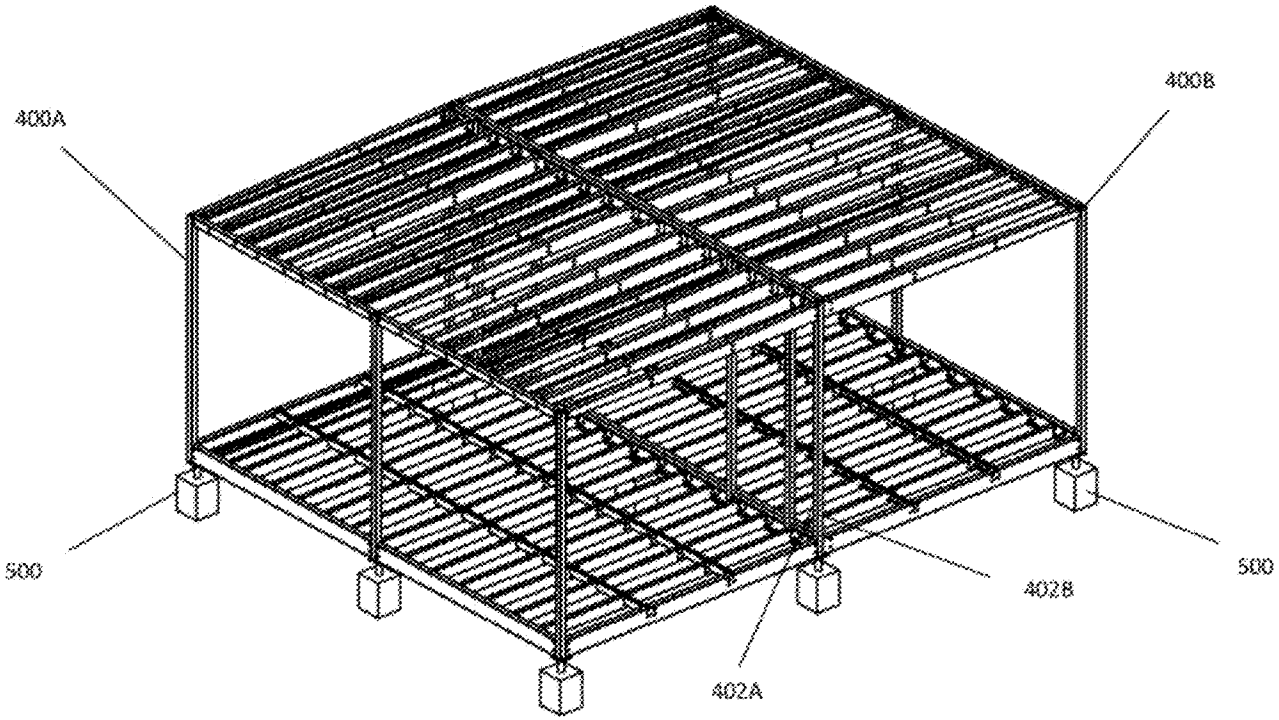
FIG. 19 shows a schematic representation of support frames of two adjacent building modules supported on a plurality of footings in accordance with an embodiment of the present invention.

Referring now to FIG. 19, there is shown an isometric view of a first support frame 400A connected to a second support frame 400B forming a building structure having two building modules. A person skilled in the art will appreciated that any number of building modules may be used to make up a building structure. The building modules may be different in dimensions, such as widths, lengths and heights. For example, for a two-storey building structure, at least one of the building modules may have a support frame with steel posts that are double in length, such as 6 m. An additional steel beam may extend horizontally at approximately half of the height of the steel posts thereby forming a support for the flooring of the second storey.

The two adjacent support frames 400A, 40B are connected to each other by connecting a steel post 402A of the first support frame 400A with an adjacent steel post 402B of the second support frame 400B. For example, each steel post 402A, 402B may be a channel beam wherein the steel posts 402A, 402B are arranged such that the respective C-channels face away from each other. In other words, the rectangular webs of the steel posts 402A, 402B abut each other and can be connected to each other using mechanical fasteners.

In this particular example, tie rods (not shown) are only provided between top and bottom channel beams that are part of resulting boundary walls. The reason for this is that there is typically no need to provide tie rods within internal wall panels. The prefabricated wall panels forming internal walls may be directly attached to the support frames 400A, 400B.

Figure 20:
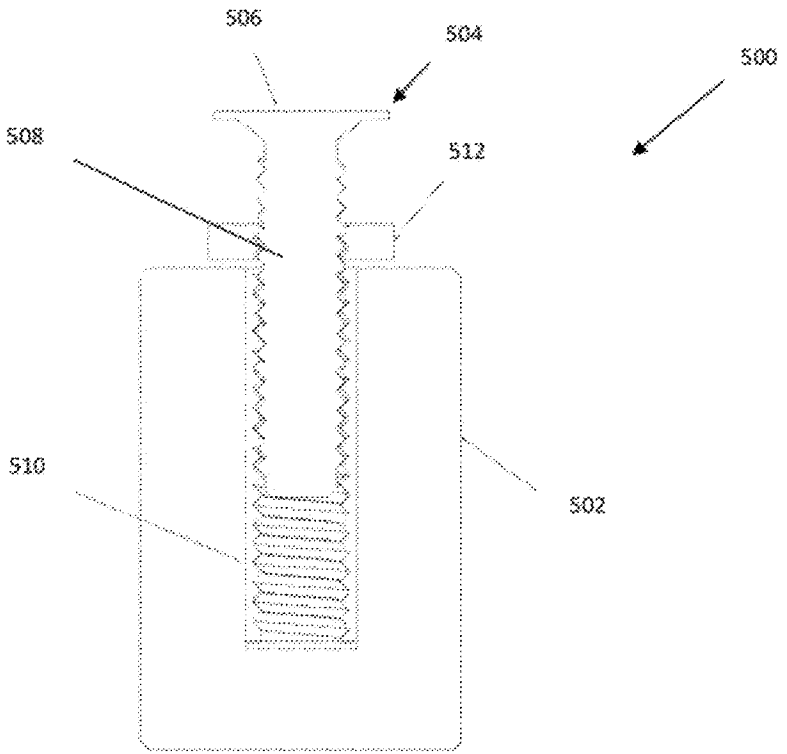
FIG. 20 is a side view of a footing of the building modules of FIG. 19.

The first and second support frames 400A, 400B are supported by a plurality of footings 500. In this particular example, the first and second support frames 400A, 400B are supported by 9 footings 500. This is due to the shared boundary between the first support frame 400A and the second support frame 400B where both support frames 400A, 400B share the footings 500. A side view of an exemplary footing 500 is shown in detail in FIG. 20. Each footing 500 comprises a concrete body 502 which may be in the form of a block. However, a person skilled in the art will appreciate that other shapes are envisaged. The footing 500 further comprises a support element 504 that is height adjustable. The support element 504 comprises a connection plate 506 that is directly attachable to the support frame 400, and a threaded leg 508 that can be inserted into a threaded bush 510 of the concrete body 502. Thus, a height of the connection plate 506 can be adjusted by turning the support element 504 within the threaded bush 510. In this way, levelling of the support frame of the building structure may be simplified. In this example, the footing 500 further comprises a locking nut 512 to lock the threaded leg 508 in position.

Figure 21:
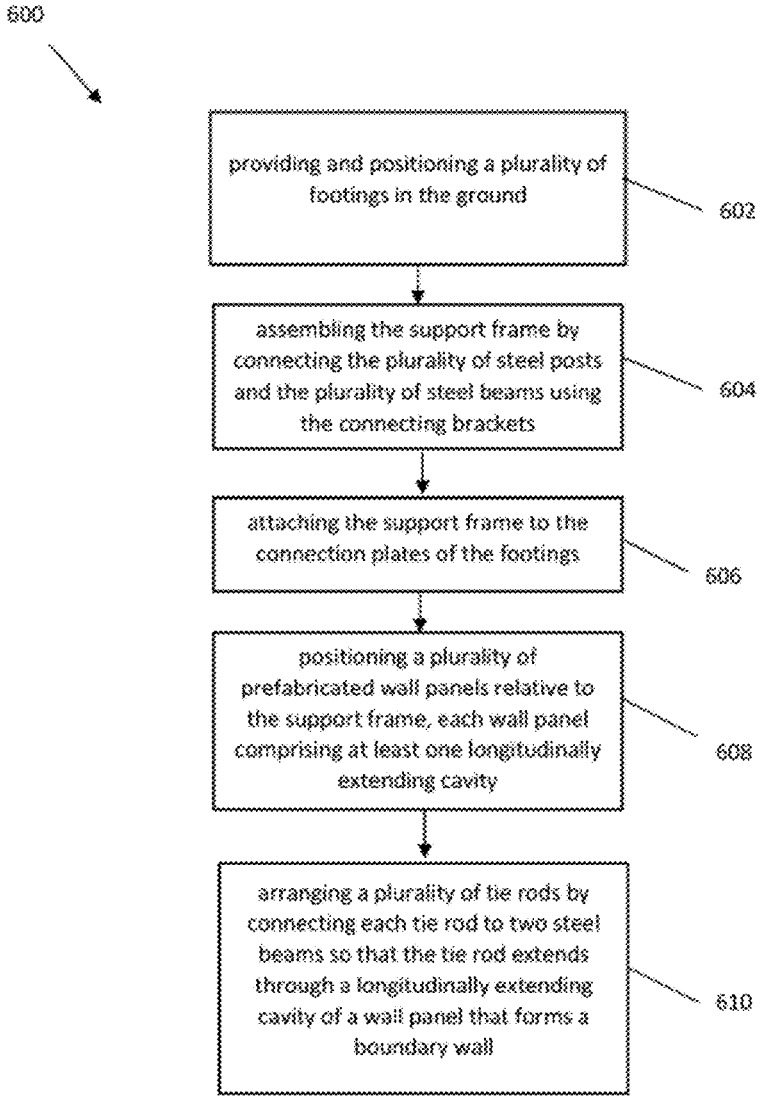
FIG. 21 is a flow chart illustrating a method of assembling a building module in accordance with an embodiment of the present invention.

Referring now to FIG. 21, there is shown a flowchart illustrating a method 600 of assembling a building structure, such as building structure 300 shown in FIG. 11. The method may include an initial step 602 of positioning a plurality of footings 500 in the ground. In a further step 604, the support frame is assembled by connecting the plurality of steel posts and the plurality of steel beams using the connecting brackets. Once the support frame is assembled, the support frame may be attached 606 to the connection plates of the footings. However, a person skilled in the art will appreciate that at least some of the separable parts of the support frame may be attached to the footings prior to fully assembling the support frame. This may simplify the process of levelling the building structure.

In a further step 608, the plurality of prefabricated wall panels are positioned relative to the support frame, wherein each prefabricated wall panel comprising at least one longitudinally extending cavity. Subsequently, a plurality of tie rods are arranged 610 by connecting each tie rod to two steel beams so that the tie rod extends through a longitudinally extending cavity of a wall panel that forms a boundary wall. In this way, the prefabricated wall panels may be attached to the support frame. However, alternative or additional method of securing the wall panels to the support frame are envisaged. The tie rods may be positioned to be fixated to opposite steel beams of the support frame, such as top and bottom channel beams. The tie rods may be connected to the channel beams under tension.

Other assembling steps may follow, such as attaching internal and external cladding to the walls, installing an electricity and plumbing system, and attaching roof panels and flooring panels to the support frame. A building structure comprising one or more building modules as described above has significant advantages. For example, a transport volume of the building structure may be minimised. Thus, transport and assembling of the building structure may be simplified which in turn reduces costs that would otherwise be necessary for skilled workers and specialised machinery.

For example, some or all components of the support frame or even the entire building structure may be connected to each other using mechanical fasteners or systems, such as bolts or threaded rods. As such, there is no or a reduced need for welding at the building site.

With regard to the transport of the prefabricated components of the building structure, the separable parts of the building structure are configured to be stackable. In this way, the transport volume can be minimised. For example, the components of the building structure may be packaged in a plurality of packs that may or may not be positioned on a pallet. A first pack may, for example, comprise the separable parts forming the support frame. A second pack may comprise a plurality of prefabricated wall panels. A third pack may comprise external and internal cladding. A fourth pack may comprise components for an electricity and/or a plumbing system. A fifth pack may comprise roof panels and a sixth pack may comprise flooring panels. The plurality of packs may be numbered in an order that defines how the building structure needs to be assembled. In this way, workers on the building site can readily identify which pack needs to be unpacked for the assembly of the prefabricated building.

With regard to the separable parts forming the support frame, the steel beams may be configured to be positioned within each other such that a volume of the transport pack can be decreased. For example, if the steel beams are channel beams as described above, a channel beam may be positioned within a channel of another channel beam that has a larger width. Also, two channel beams may interlock with each other by positioning the channel beams such that the respective channels face each other. In this way, a more compact transport pack can be achieved with a higher density load.

In one specific embodiment, all components of the building structure may be flat packed and a size of a flatpack may be defined by a footprint of the largest component of each pack. Each flatpack may meet flat pack pallet standards of the North Atlantic Trade Organisation (NATO). The transport packs may further comprise material that is arranged to protect corners and edges of the separable parts of the prefabricated building. This may reduce or even prevent logistical damage when the transport packs are moved to the building site.

It will be appreciated by persons skilled in the art that numerous variations and/or modifications may be made to the invention as shown in the specific embodiments and/or aspects without departing from the spirit or scope of the invention as broadly described. For example, it will be apparent that certain features of the invention can be combined to form further embodiments. The present embodiments and aspects are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings.

| List of numerals | |
|---|---|
| Footing | 100 |
| Piling structure | 102 |
| Vertical building column | 104 |

-continued

| List of numerals | |
|---|---|
| Base structure | 106 |
| Base plate | 108 |
| Alignment bars | 110 |
| Concrete layers | 112 |
| Web | 113 |
| Apertures in concrete layers | 114 |
| Connectors | 115 (for alignment bars) |
| Centre column | 116 |
| Centre aperture | 118 |
| Shaft components | 120 122 |
| Shaft bit | 124 |
| Helical plates | 126 |
| Column plate | 128 |
| Column reinforcement bars | 130 |
| Protrusions on column plate | 132 |
| Connectors | 134 (for slab reinforcement bars) |
| Slab reinforcement bars | 136 |
| Reinforcement mesh | 137 |
| Steel tubes | 138 |
| Lifting elements | 140 |
| Method | 200 |
| Prefabricated building structure | 300 |
| Prefabricated wall panel | 302 |
| Prefabricated roof panel | 304 |
| Window | 306 |
| Door | 308 |
| Fenced terrace | 310 |
| Stairs | 312 |
| Core | 320 |
| Outer layers | 322, 324 |
| Tie rod | 326 |
| Cavity | 328 |
| Space (abutment) | 330 |
| Support frame | 400 |
| Steel post | 402 |
| Channel beam (10 cm width) | 403 |
| Channel beam (15 cm width) | 404 |
| Channel beam (20 cm width) | 405 |
| Channel beam (forming roof support) | 406 |
| Rectangular web | 408 |
| First flange | 410 |
| Second flange | 412 |
| Inner surface (of web) | 414 |
| Outer surface (of web) | 416 |
| First end (of web) | 418 |
| Second end (of web) | 420 |
| First side (of web) | 422 |
| Second side (of web) | 424 |
| Inner side (of first flange) | 426 |
| Outer side (of first flange) | 428 |
| Inner side (of second flange) | 430 |
| Outer side (of second flange) | 432 |
| First lip | 434 |
| Second lip | 436 |
| First end (of steel post) | 438 |
| Second end (of steel post) | 440 |
| First connecting bracket | 442 |
| Base plate (of first connecting bracket) | 444 |
| Pair of apertures (of base plate) | 446 |
| First bracket flange of first connecting bracket | 448 |
| Second bracket flange of first connecting bracket | 450 |
| Third bracket flange of first connecting bracket | 452 |
| Pair of apertures (of third bracket flange) | 454 |
| Second connecting bracket | 456 |
| Base of second connecting bracket | 458 |
| Pair of apertures of base | 460 |
| First bracket flange (of second connecting bracket) | 462 |
| Second bracket flange (of second connecting bracket) | 464 |
| Third bracket flange (of second connecting bracket) | 466 |
| Third connecting bracket | 468 |
| First bracket flange (of third connecting bracket) | 470 |
| Second bracket flange (of third connecting bracket) | 472 |
| Apertures | 474, 476 |

-continued

| List of numerals | |
|---|---|
| Bracket recess | 478 |
| First end (of roof support) | 480 |
| Second end (of roof support) | 482 |
| Web | 484 |
| Footing | 500 |
| Concrete body | 502 |
| Support element | 504 |
| Connection plate | 506 |
| Threaded leg | 508 |
| Threaded bush | 510 |
| Locking nut | 512 |
| Method | 600 |

The invention claimed is:

1. A footing for a building structure, the footing comprising:

a plurality of precast concrete layers, each precast concrete layer comprising reinforcement bars and a plurality of apertures, and a base structure comprising a base plate and a plurality of alignment bars protruding from a first surface of the base plate, wherein the footing is configured such that when the plurality of precast concrete layers are positioned on top of one another, the plurality of alignment bars of the base structure extend through respective apertures of each concrete layer, wherein the footing further comprises a piling structure that is secured to the base structure via a second surface of the base plate that is opposite to the first surface, and wherein one or more of the precast concrete layers comprises a plurality of slab reinforcement bars that, in use, extend from the footing into a concrete slab to connect the footing with a further footing.

2. The footing of claim 1 further comprising a centre column arranged to be directly secured to the piling structure.

3. The footing of claim 2 wherein each precast concrete layer comprises a central aperture and the footing is configured such that when the plurality of precast concrete layers are positioned on top of one another, the centre column extends through the respective central apertures of the plurality of prefabricated concrete layers.

4. The footing of claim 1 wherein each concrete layer comprises a plurality of steel tubes connected to the reinforcement bars, the plurality of steel tubes defining the plurality of apertures for receiving the respective alignment bars when the concrete layer is cast.

5. The footing of claim 1 wherein the base plate comprises connectors arranged to receive the alignment bars such that the alignment bars protrude substantially perpendicular from the base plate.

6. The footing of claim 1 comprising a column plate that is arranged to secure the footing to a vertical column of a building structure such that the footing directly supports the vertical column of the building structure.

7. The footing of claim 6 wherein one or more of the plurality of precast concrete layers comprises apertures for receiving column reinforcement bars to secure the column plate to the one or more of the plurality of precast concrete layers.

8. The footing of claim 1 being arranged such that when the footing is connected to a vertical column of the building structure, the footing, the vertical column and the piling structure are substantially aligned.

9. The footing of claim 1 wherein each concrete layer comprises reinforcement steel bars.

10. The footing of claim 9 wherein each concrete layer comprises a reinforcement steel mesh.

11. The footing of claim 1, wherein the piling structure comprises one or more screw or helical piles.

12. The footing of claim 11 wherein the piling structure has an overall conical shape.

13. The footing of claim 1 wherein each precast concrete layer comprises one or more lifting elements such that each precast concrete layer can be lifted by a lifting or handling machine.

14. A building structure or a foundation for a building structure comprising a plurality of footings in accordance with claim 1.

15. A method of making a footing for a building structure, the method comprising:

providing a base structure comprising a base plate, a plurality of alignment bars protruding from a first surface of the base plate, and a piling structure secured to the base structure via a second surface of the base plate that is opposite to the first surface; and providing a plurality of precast concrete layers, wherein each concrete layer is made by:

a) providing reinforcement bars for reinforcing a concrete layer;

b) connecting a plurality of spacer chairs to the reinforcement bars such that the reinforcement bars are elevated when positioned on a surface;

c) connecting a plurality of steel tubes to the reinforcement bars such that when the concrete layer is cast, the steel tubes form a plurality of apertures that are arranged to receive the respective alignment bars of the base structure when the footing is assembled; and d) pouring concrete into a casting mould to form the concrete layer, wherein for one or more precast concrete layers, the method comprises a step of connecting a plurality of slab reinforcement bars that, in use, extend from the footing into a concrete slab to connect the footing with a further footing.

16. A method of forming a foundation of a building structure, the method comprising:

providing a footing comprising a plurality of precast concrete layers, each precast concrete layer comprising reinforcement bars and a plurality of apertures, the footing further comprising a base structure comprising a base plate and a plurality of alignment bars protruding from the base plate;

securing a piling structure to the base plate of the footing;

positioning the piling structure and the base plate within a ground where the building structure is to be erected;

positioning the plurality of precast concrete layers on top of one another such that the plurality of alignment bars of the base structure extend through respective apertures of each concrete layer, and securing a vertical column of the building structure to the footing.

17. The method of claim 16 comprising:

providing concrete slab between a plurality of footings, wherein one or more of the precast concrete layers of each footing comprises connectors arranged to receive slab reinforcement bars extending into the concrete slab between the plurality of footings.

* * * * *